US007540108B2

(12) United States Patent
Irwin et al.

(10) Patent No.: US 7,540,108 B2
(45) Date of Patent: Jun. 2, 2009

(54) SHOTGUN SIGHT AND ADJUSTABLE GUN SIGHT

(76) Inventors: Jere F. Irwin, P.O. Box 10668, Yakima, WA (US) 98909; Dale L. Vantrease, P.O. Box 448, Naches, WA (US) 98937; Cole E. Orcutt, 6808 W. Yakima Ave., Apt. #2, Yakima, WA (US) 98937

( * ) Notice: Subject to any disclaimer, the term of this patent is extended or adjusted under 35 U.S.C. 154(b) by 0 days.

(21) Appl. No.: 11/651,301

(22) Filed: Jan. 8, 2007

(65) Prior Publication Data

US 2009/0113780 A1 May 7, 2009

(51) Int. Cl.
*F41G 1/00* (2006.01)

(52) U.S. Cl. ..... 42/112; 42/135; 42/136; 42/138

(58) Field of Classification Search ..... 42/111, 42/112, 138, 135, 136
See application file for complete search history.

(56) References Cited

U.S. PATENT DOCUMENTS

| | | | | | |
|---|---|---|---|---|---|
| 420,261 | A | | 1/1890 | Blankman | |
| 533,003 | A | | 1/1895 | Dieffenbach | |
| 535,379 | A | | 3/1895 | Kennedy | |
| 592,740 | A | * | 10/1897 | Kennedy | 42/138 |
| 658,709 | A | | 9/1900 | Fischer | |
| 714,263 | A | | 11/1902 | Trotter | |
| 937,244 | A | | 10/1909 | Kennedy | |
| 1,070,767 | A | | 8/1913 | Brauning | |
| 1,076,658 | A | | 10/1913 | Bechdoldt | |
| 1,101,163 | A | * | 6/1914 | Brauning | 42/138 |
| 1,437,796 | A | | 12/1922 | Fisher | |
| 1,440,291 | A | | 12/1922 | Harkom | |
| 1,485,064 | A | * | 2/1924 | Berger | 42/138 |
| 1,573,515 | A | | 2/1926 | Harkom | |
| 2,446,970 | A | | 8/1948 | Wilson | |
| 2,484,368 | A | | 10/1949 | Young | |
| 2,593,870 | A | * | 4/1952 | Ganzhorn | 42/135 |
| 2,693,659 | A | * | 11/1954 | Simmons | 42/76.01 |
| 3,005,263 | A | * | 10/1961 | Lockwood | 33/228 |
| 3,260,008 | A | * | 7/1966 | Yeomans, Jr. | 42/111 |
| 3,556,889 | A | * | 1/1971 | Grahn | 156/91 |
| 4,010,564 | A | * | 3/1977 | Pettit | 42/112 |
| 4,117,617 | A | * | 10/1978 | Linde et al. | 42/112 |
| 4,143,465 | A | * | 3/1979 | White | 42/112 |

(Continued)

*Primary Examiner*—Stephen M Johnson
*Assistant Examiner*—Daniel J Troy
(74) *Attorney, Agent, or Firm*—Wells St. John P. S.

(57) ABSTRACT

A shotgun sight is provided with a barrel, a sighting rib, a rib support member, a pitch adjustment mechanism, and a latch mechanism. The rib support member is provided on the barrel. The pitch adjustment mechanism is provided between the rib and the rib support member to adjust pitch of the rib relative to the barrel. The latch mechanism has a pair of coacting base plates. A first base plate is provided along a proximal end of the rib and a second base plate is provided on the rib support member. Each base plate has an array of complementary-shaped interlocking projections. One of the base plates is configured to be forcibly urged apart from the other base plate to reposition the array of interlocking projections in order to selectively position the rib relative to the barrel at one of a plurality of locations each corresponding with a unique pitch for the rib relative to the barrel. An adjustable gun sight is also provided.

19 Claims, 25 Drawing Sheets

U.S. PATENT DOCUMENTS

| | | | | | |
|---|---|---|---|---|---|
| 4,203,243 | A | * | 5/1980 | Hickman | 42/73 |
| 4,878,308 | A | * | 11/1989 | Rose | 42/112 |
| 4,993,158 | A | | 2/1991 | Santiago | |
| 5,443,543 | A | * | 8/1995 | Epes et al. | 42/112 |
| 5,715,626 | A | * | 2/1998 | Scaramucci | 42/112 |
| 6,338,219 | B1 | | 1/2002 | Watson, Jr. et al. | |
| 6,662,486 | B2 | * | 12/2003 | Komberger | 42/138 |
| 6,839,999 | B2 | * | 1/2005 | Beretta | 42/112 |
| 6,968,643 | B2 | | 11/2005 | Woodbury | |
| 2004/0200116 | A1 | * | 10/2004 | Gussalli Beretta | 42/112 |
| 2007/0204502 | A1 | * | 9/2007 | Popikow | 42/112 |

* cited by examiner 12
14
24
26
32
34
35
59
100-0

34
59
60
64
66
94
62
92
26
24
100-0
26
36
46
129
52
70
24
100-0

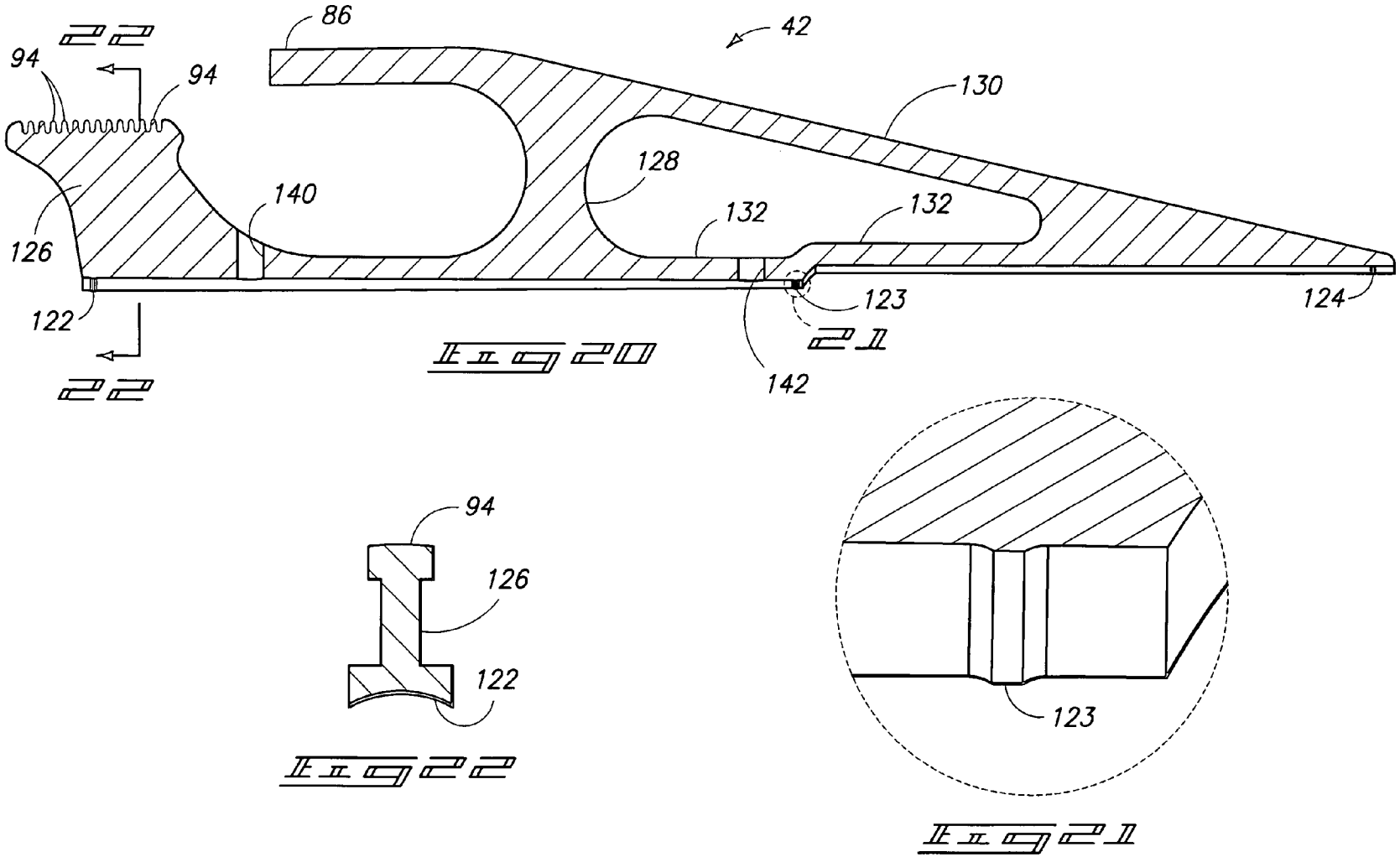
42
86
94
94
126
122
140
128
132
132
130
123
124
142
123
94
126
122
22
22
20
21
22

SHOTGUN SIGHT AND ADJUSTABLE GUN SIGHT

TECHNICAL FIELD

This invention pertains to sights for firearms. More particularly, the present invention relates to adjustable gun sights for shotguns.

BACKGROUND OF THE INVENTION

Adjustable gun sights have previously been provided on firearms, such as shotguns. U.S. Pat. No. 4,117,617 discloses various embodiments of an adjustable gun sight provided on a single barrel shotgun. More particularly, front and rear cam mounts are provided on a shotgun along with an adjustment mechanism, such as an adjustable detent wheel, a thumb screw, or a threaded actuating member provided in the center or rear of the sighting rib to enable a user to adjust pitch of a sighting rib on the gun sight. These embodiments typically use a fixed center pivot point on the sight along with front and rear mounting brackets that incorporate a cam or angled slot. Each cam supports a respective end of the sighting rib about the center pivot point and a hand or tool actuated adjustment mechanism, such as a threaded member, a rack and pinion, or a dovetail surface is used to adjust the operating pitch of the sight relative to a barrel. However, such adjustment mechanisms typically require a tool or significant tactile manipulation of the mechanism in order to adjust the pitch (angle) position of the sighting rib. Secondly, the sighting rib is only supported at three discrete locations. Therefore, the sighting rib is designed to provide self-sufficient structural stiffness, which increases the wind drag of the sight when provided on a barrel.

Accordingly, improvements are needed to gun sights in order to reduce the depth of the sighting rib in order to reduce windage when mounted atop a gun barrel. Further, more improvements are needed to simplify the adjustment operations for repositioning the sighting rib to realize a desired pitch relative to a barrel. More particularly, the need for tools should be eliminated and the provision of discrete, repeatable positioning should also be realized.

SUMMARY OF THE INVENTION

An improved adjustable gun sight is provided with a sighting rib that can be quickly and easily adjusted between a plurality of discrete pitch angles relative to an associated gun barrel. A latch mechanism is provided on a sighting rib that enables engagement and disengagement of the rib relative to the barrel when adjusting relative pitch angles therebetween via simple tactile manipulation of a finger tab by coacting against a spring during readjustment of the sighting rib relative to the barrel.

According to one aspect, a shotgun sight is provided with a barrel, a sighting rib, a rib support member, a pitch adjustment mechanism, and a latch mechanism. The rib support member is provided on the barrel. The pitch adjustment mechanism is provided between the rib and the rib support member to adjust pitch of the rib relative to the barrel. The latch mechanism has a pair of coacting base plates. A first base plate is provided along a proximal end of the rib and a second base plate is provided on the rib support member. Each base plate has an array of complementary-shaped interlocking projections. One of the base plates is configured to be forcibly urged apart from the other base plate to reposition the array of interlocking projections in order to selectively position the rib relative to the barrel at one of a plurality of locations each corresponding with a unique pitch for the rib relative to the barrel.

According to another aspect, an adjustable gun sight is provided with a support base, a sighting rib, a pitch adjustment structure, and a latch connection. The support base has a mounting interface configured to mount onto a gun barrel. The pitch adjustment structure is provided between the support base and the sighting rib to retain the rib relative to the mounting interface at selective pitch orientations. The latch connection has a first finger supported by the rib with a first connector portion and a second finger supported by the base with a second connector portion. One of the first finger and the second finger is movable to disengage the first connector portion and the second connector portion to articulate the pitch adjustment structure to realize a desired pitch of the rib relative to the mounting interface.

According to yet another aspect, a gun sight is provided with a barrel, an elongated sighting rib, at least four pickets, and at least four cam surfaces. The elongated sighting rib has a relatively low profile cross section and at least four mounting points spaced apart along the rib. At least four pickets are supported by the barrel. At least four cam surfaces are provided each between a respective one of the mounting points and the pickets to adjust pitch of the rib relative to the barrel.

BRIEF DESCRIPTION OF THE DRAWINGS

Preferred embodiments of the invention are described below with reference to the following accompanying drawings.

FIG. 4 is a further enlarged and broken apart perspective view of the adjustable gun sight depicted in FIG. 3.

FIG. 7 is a top view of the adjustable gun sight mounted atop a gun barrel from the gun of FIG. 1.

FIG. 7A is an enlarged view of the latch mechanism and spring lock for the adjustable gun sight from the encircled region 7A of FIG. 7.

FIG. 8A is a further enlarged and broken apart view of the adjustable gun sight and barrel of FIG. 8.

FIG. 10 is a partial, enlarged side view of the adjustable gun sight and gun of FIG. 1 illustrating a user grasping a finger tab on an adjustable latch mechanism of the adjustable gun sight prior to adjusting pitch of the sighting rib from an 80-20 shot spread to a new shot spread.

FIG. 13 is a side view of the adjustable gun sight and barrel depicted in FIG. 7 positioned for an 80-20 shot spread.

FIG. 13A is an enlarged view of a distal picket and bracket from a pitch adjustment mechanism of the adjustable gun sight taken from the encircled region 13A of FIG. 13.

FIG. 13B is an enlarged view of an engaged first connector portion and second connector portion for a latch mechanism of the adjustable gun sight taken from the encircled region 13*b* of FIG. 13.

FIG. 14 is a side view of the adjustable sighting rib assembly and barrel depicted in FIG. 7 positioned for a 60-40 shot spread.

FIG. 14A is an enlarged view of a distal picket and bracket from a pitch adjustment mechanism of the adjustable gun sight taken from the encircled region 14A of FIG. 14.

FIG. 14B is an enlarged view of an engaged first connector portion and second connector portion for a latch mechanism of the adjustable gun sight taken from the encircled region 14B of FIG. 14.

FIG. 17 is a plan view taken from above of the rear support bracket for the adjustable gun sight of FIGS. 1-16.

FIG. 18 is a side view of the rear support bracket of FIG. 17.

FIG. 19 is a left end view of the rear support bracket taken relative to the view depicted in FIG. 18.

FIG. 20 is a vertical sectional view of the rear support bracket taken along line 20-20 of FIG. 19.

FIG. 21 is an enlarged vertical sectional view of an adhesive riser taken from the encircled region 21 of FIG. 20.

FIG. 22 is a vertical sectional view of the rear support bracket taken along line 22-22 of FIG. 20.

FIG. 29 is a further enlarged vertical sectional view corresponding with the view of FIG. 8A and showing the latch mechanism and spring lock of the adjustable gun sight.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Reference will now be made to a preferred embodiment of Applicant's invention comprising an adjustable gun sight. While the invention is described by way of a preferred embodiment, it is understood that the description is not intended to limit the invention to such embodiment, but is intended to cover alternatives, equivalents, and modifications which may be broader than the embodiment, but which are included within the scope of the appended claims.

In an effort to prevent obscuring the invention at hand, only details germane to implementing the invention will be described in great detail, with presently understood peripheral details being incorporated by reference, as needed, as being presently understood in the art.

Figure 1:
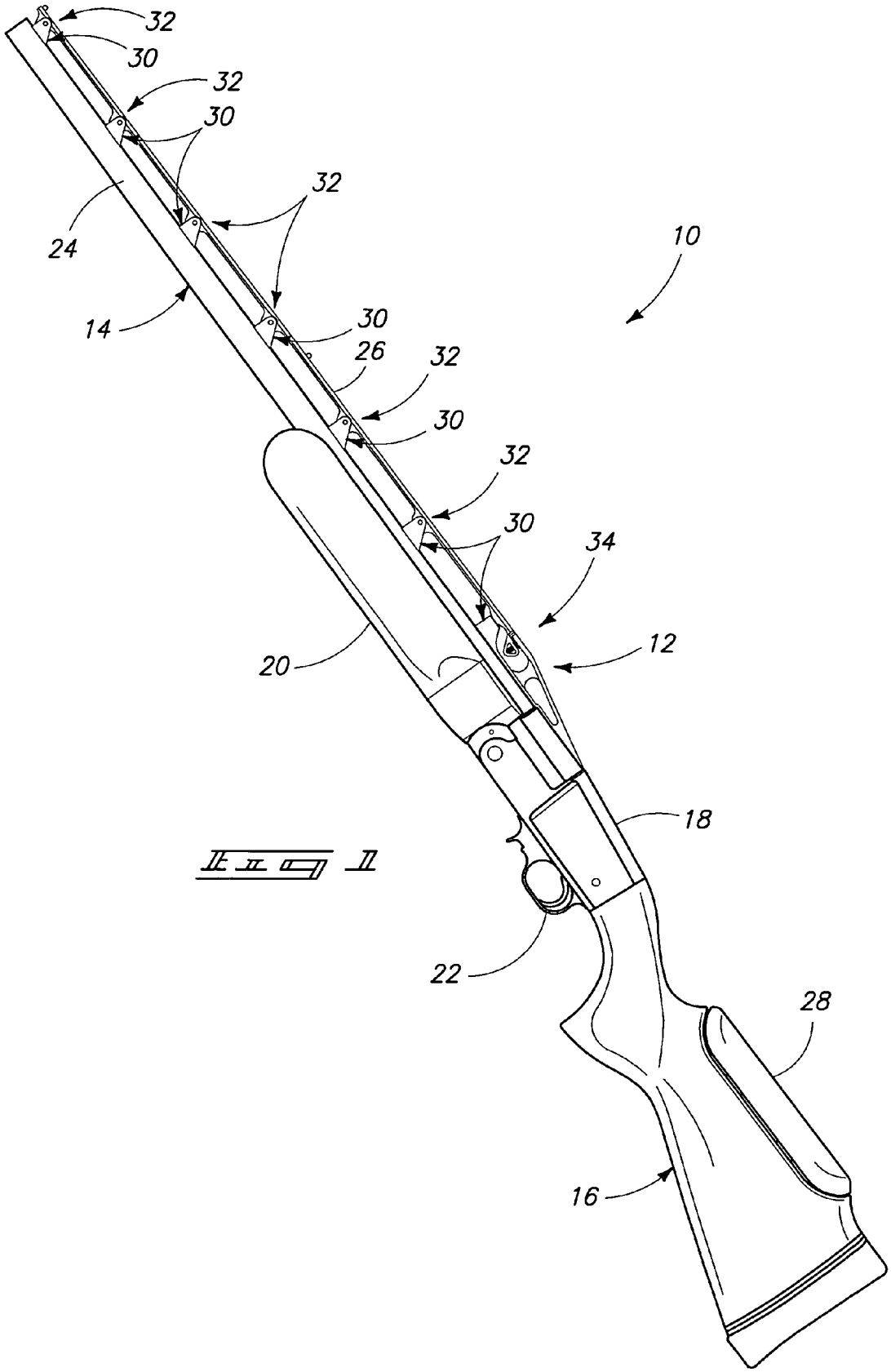
FIG. 1 is side view of a firearm having an adjustable gun sight according to one aspect of the present invention.

FIGS. 1-30 illustrate an adjustable gun sight 12 that can be provided as original equipment or as an after market accessory to a firearm, such as a shotgun 10, according to one aspect of the present invention. More particularly, an exemplary single barrel shotgun 10 is depicted in FIG. 1 with one embodiment of the present invention taking the form of adjustable gun sight 12. Gun sight 12 is mounted atop a barrel assembly 14 of shotgun 10 where it can be adjustably positioned by a user between different positions in order to adjust the placement of shot to a desired elevation orientation when using gun sight 12 relative to a barrel assembly 14.

Although adjustable gun sight 12 is shown implemented on a single barrel shotgun 10, it is understood that the features of this gun sight can also be implemented on other types of shotguns such as multiple barrel shotguns (over-under and side-by-side barrel shotguns), semi-automatic shotguns, and other forms of firearms. Pursuant to the implementation depicted in FIG. 1, shotgun 10 has a stock 16 that is affixed onto a receiver 18 and a forearm 20 that is affixed onto barrel assembly 14. A trigger mechanism is affixed onto the receiver 18. An adjustable stock member 28 on stock 16 enables a user to adjust the elevational positioning of their sighting eye relative to a sighting rib 26 of gun sight 12 in order to maintain repeatable placement of the eye along a desired line of sight relative to sighting rib 26.

Adjustable gun sight 12 includes sighting rib 26 which is carried for repositioning atop barrel 24 by a rib support member 30. Rib support member 30 is rigidly affixed onto a top surface of barrel 24 using an adhesive. One exemplary adhesive is an epoxy adhesive/sealant sold by Master Bond Inc, 154 Hobart Street, Hackensack, N.J. 07601 under the name MasterBond Supreme 10 HT, in black. Optionally, rib support member 30 can be formed integrally from a top surface of barrel 24. For the case where rib support member 30 is affixed onto barrel 24 after manufacture, rib support member 30 can be formed from a plurality of elements that are mechanically and/or adhesively affixed, or soldered, or welded atop barrel 24. Such a construction facilitates after-market modification of an existing shotgun barrel 24 in order to add features of gun sight 12 thereto after original manufacture.

As shown in FIG. 1, sighting rib 26 is shown positioned relative to barrel 24 at one of a plurality of unique pitch positions, or angles, relative to barrel 24. A pitch adjustment mechanism 32 supports sighting rib 26 for selective positioning atop rib support member 30. A latch mechanism 34 provides for selective positioning of sighting rib 26 via pitch adjustment mechanism 32 atop barrel 24 in order to lock the articulated position of sighting rib 26 relative to barrel 24 at one of a plurality of selected positions. A spring lock 35 (see FIG. 2) locks the selected position of sighting rib 26 that has been achieved by kinematically articulating pitch adjustment mechanism 32 in order to affix the selected position of latch mechanism 34 and prevent inadvertent deselection of the selected position. Further construction and operation details of spring lock 35 will be discussed below.

Figure 2:
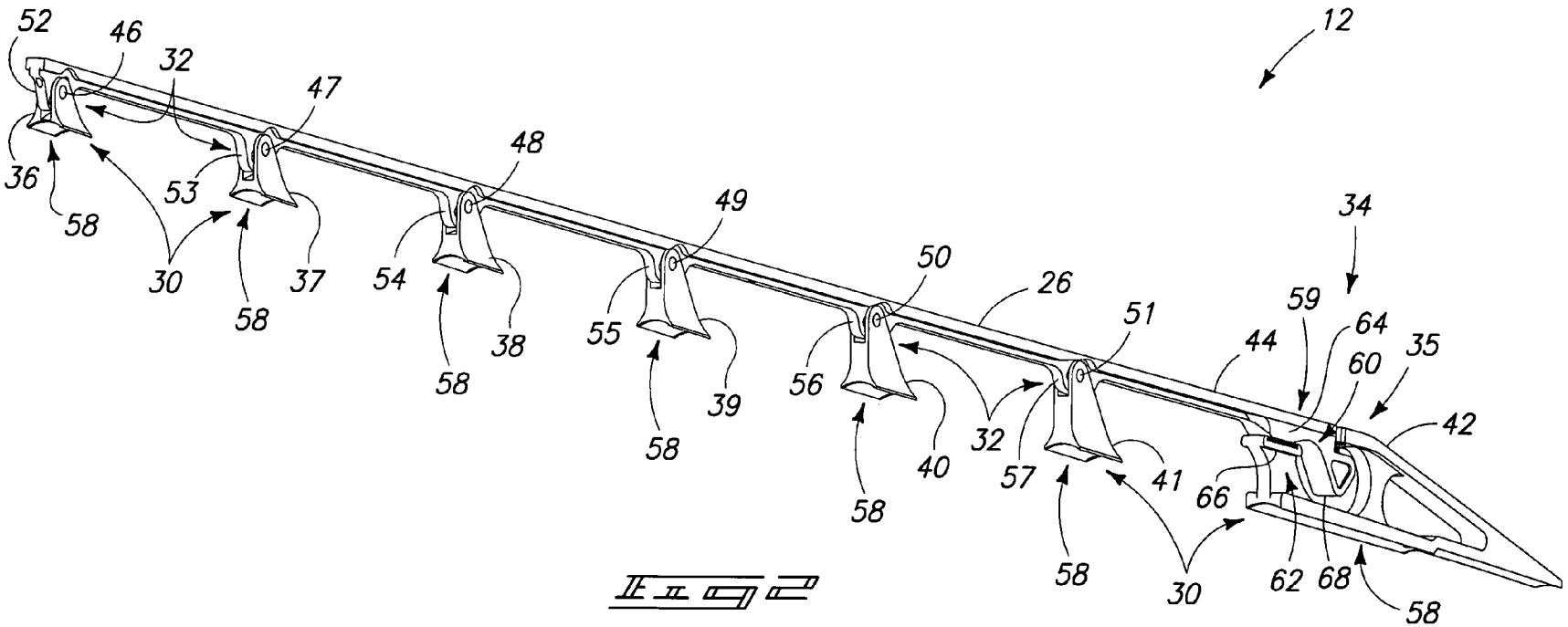
FIG. 2 is a perspective view from below of the adjustable gun sight of FIG. 1.

As shown in FIG. 2, sighting rib 26 of gun sight 12 is supported atop a gun barrel (not shown) via rib support member 30 which comprises a plurality of discretely spaced apart pickets 36-41 and a rear support bracket 42. Each picket 3641 comprises a discrete support bracket that is configured to receive a corresponding pin 46-51 that is adhesively affixed to the respective picket 36-41. One suitable adhesive is Loctite adhesive sold by Henkel Loctite Corporation, 1001 Trout Brook Crossing, Rocky Hill, Conn. 06067. Alternatively, any urethane, epoxy, cyanoacrylate, or other adhesive can be used. Each pin 46-51 is configured to be received through a cam slot 70-75 (see FIG. 3) provided in a respective bracket 52-57 that is integrally formed from sighting rib 26. Cam slots 70-75 (see FIG. 3) are each constructed to have a unique guide path that causes sighting rib 26 to kinematically pitch relative to a gun barrel while atop pickets 36-41 as sighting rib 26 is moved fore-and-aft relative to pickets 36-41. Further details of the construction cam slots 70-75 will be discussed below in greater detail with reference to FIGS. 4-6.

Figure 3:
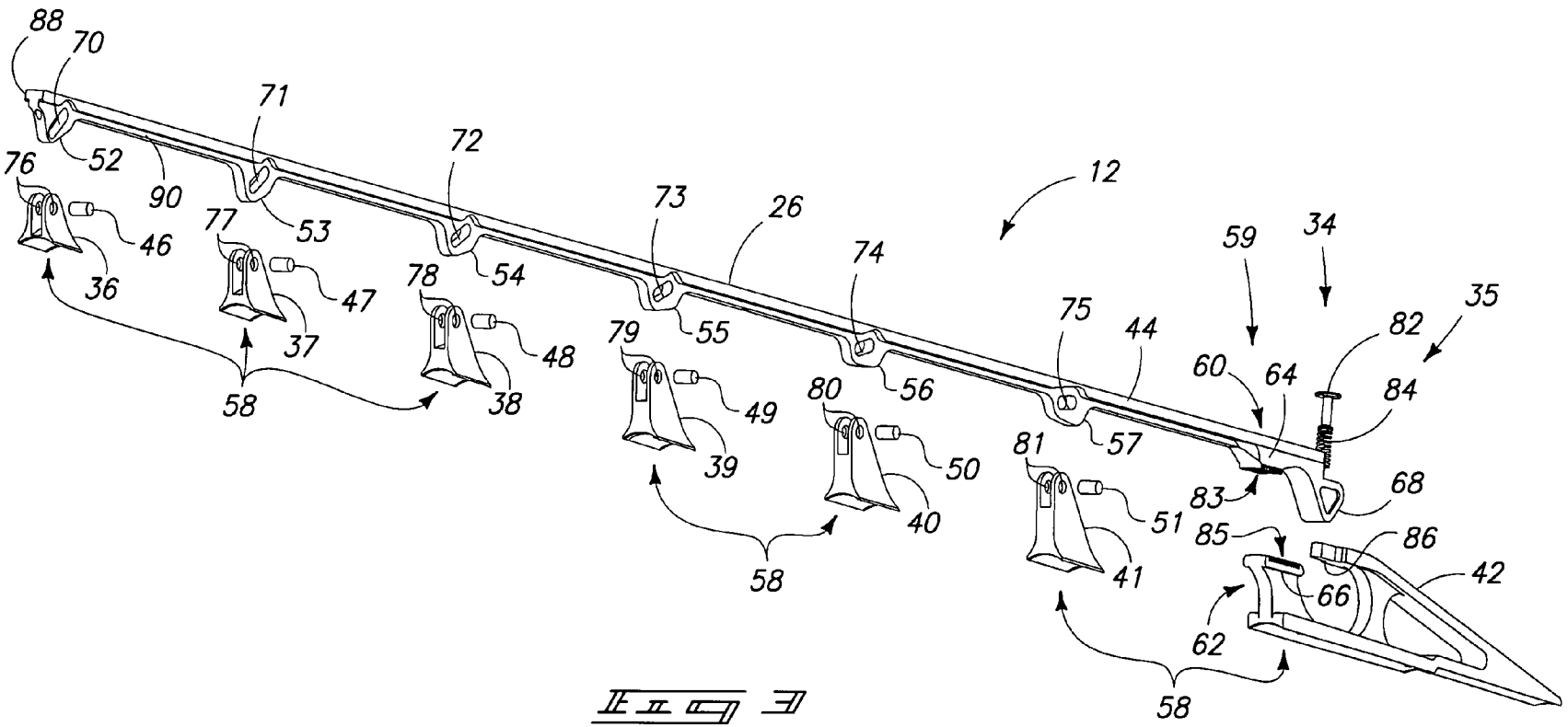
FIG. 3 is an exploded perspective view from below of the adjustable gun sight of FIGS. 2-3.

As shown in FIGS. 2 and 3, rib support member 30 is affixed atop a shotgun barrel (not shown) along a mounting interface 58. Mounting interface 58 is provided by a bottom conforming surface on pickets 36-41 and rear support bracket 42. Such mounting interface 58 is configured to conform substantially with an upper surface of a shotgun barrel. According to one construction, such mounting interface 58 is used to mechanically and adhesively affix rib support member 30 atop a shotgun barrel, according to one construction.

FIG. 2 illustrates the provision of latch mechanism 34 along a proximal end portion of sighting rib 26. More particularly, latch mechanism 34 includes a connector 59 and spring lock 35. Connector 59 includes a first connector portion 60 and second connector portion 62 that are configured to be selectively positioned one relative to the other at discrete locations in interlocking relation therebetween. First connector portion 60 is provided along a bottom surface of a base plate 64 formed along proximal end portion 44 of sighting rib 26. Second connector portion 62 is provided along a base plate 66 that is integrally formed by rear support bracket 42. A structural member in the form of a finger tab 68 is formed by a terminating portion of proximal end portion 44 on sighting rib 26 to facilitate tactile manipulation of proximal end portion 44 which causes upward flexing of proximal end portion 44 to compress a spring 84 (see FIG. 3) and plunger 82 against a bottom surface of rear support bracket 42 so as to separate connector portions 60 and 62 to facilitate relative repositioning therebetween when moving sighting rib 26 to and fro relative to rib support member 30 so as to adjust relative pitch therebetween.

FIGS. 3 and 4 illustrate the provision of a pair of complementary apertures 76-81 provided in respective pickets 36-41 and sized to receive a complementary pin 46-51 with a snug fit therebetween. According to one construction, pins 46-51, pickets 36-41 and support bracket 42 are each formed from steel. Also, according to one construction, sighting rib 26 is formed from anodized aluminum. Optionally, sighting rib 26 and components of rib support member 30 can be formed from any of a number of suitable structural materials such as steel, aluminum, stainless steel, composite materials, or other alloy materials or suitable structural materials.

Figure 5:
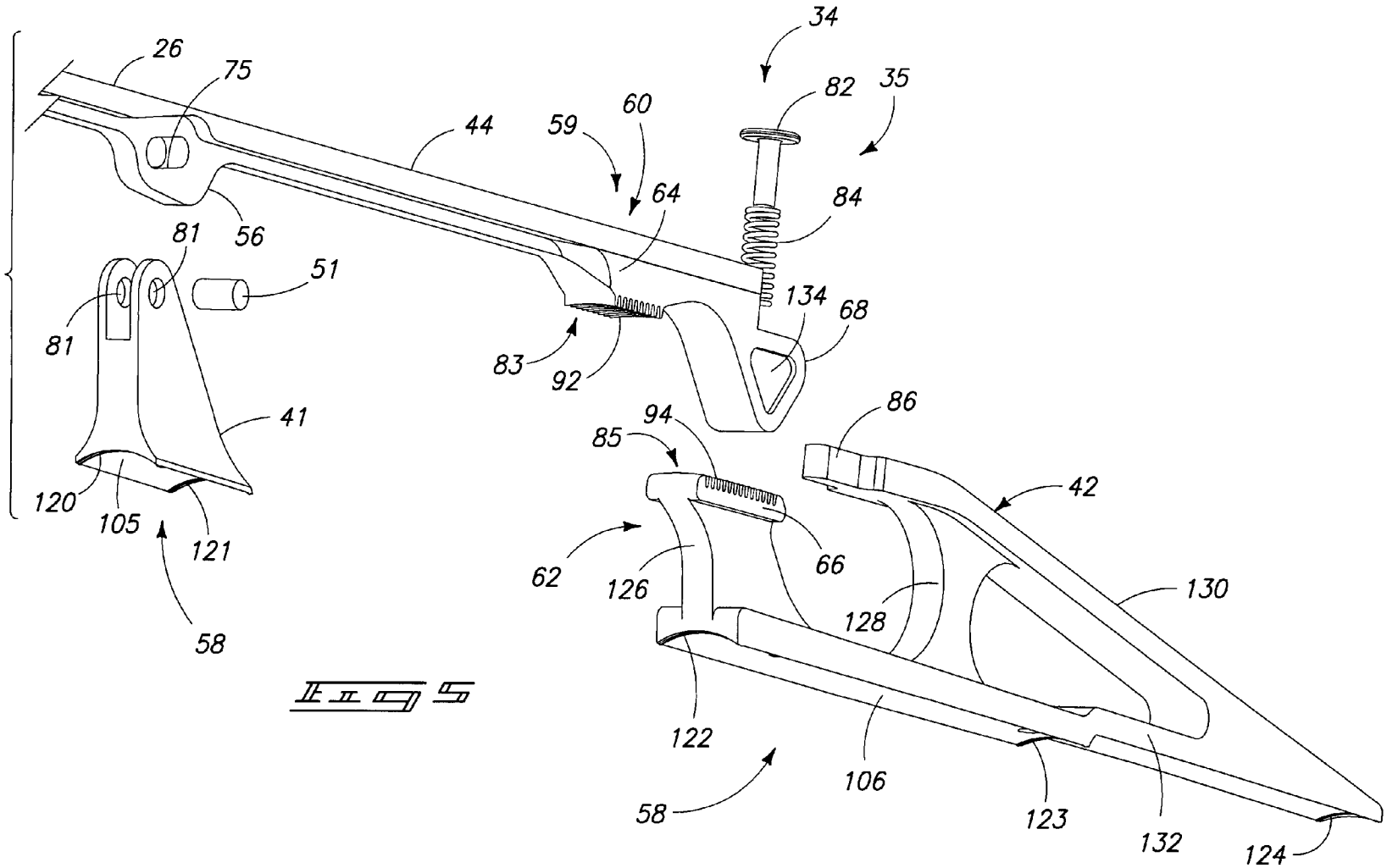
FIG. 5 is a further enlarged and broken apart perspective view from below of a rear portion of the adjustable gun sight of FIGS. 1-4 and corresponding with the view depicted in FIG. 4.

FIGS. 4 and 5 illustrate in progressively enlarged views construction details of adjustable gun sight 12 in exploded perspective view. More particularly, mounting interface 58 is illustrated in greater detail comprising adhesive surfaces 100-105 provided on pickets 36-41 and adhesive surface 106 provided on support bracket 42. A pair of spaced apart adhesive risers 110, 111; 112, 113; 114, 115; 116, 117; 118, 119; and 120, 121 are provided along each adhesive surface 100-105 of pickets 3641, respectively. Likewise, a similar pair of adhesive risers 122, 123 are provided along surface 106 of support bracket 42.

As shown in FIG. 4, sighting rib 26 is formed from a single piece of anodized aluminum alloy with a horizontal flange 88 and a vertical flange 90 that cooperate to form a modified T-shaped cross-sectional configuration. Flange 90 is enlarged at discreet locations so as to form brackets 52-57 therealong. A pair of through bores 125 and 127 extend completely through sighting rib 26 from a top surface to a bottom surface. According to one construction, bores 125 and 127 are subsequently tapped with threads, after which a sighting bead having a tapered base stem is urged into each bore 125 and 127. Preferably, the tapered stem on each sighting bead is formed from a resilient material, such as a plastic material which is urgably and forcably engaged within the threads in bore 125 and 127 via axial insertion. Exemplary beads 129 and 131 are shown in bores 125 and 127 in FIG. 8A.

FIGS. 4 and 5 further illustrate construction details of latch mechanism 34; namely spring lock 35 and connector 59. As shown in FIG. 5, first connector portion 60 has a first complementary surface 83 and second connector portion 62 has a likewise second complementary surface 85. Surfaces 83 and 85 each comprise a plurality of repeating arcuate projections 92 and 94 which are formed in complementary arrays atop base plates, or members 64 and 66, respectively.

As shown in FIG. 5, support bracket 42 includes a pair of integrally formed structural ribs 126 and 128. Rib 126 extends between a bottom plate 132 and base plate 66. Similarly, rib 128 extends between bottom plate 132 and a top plate 130. Top plate 130 terminates in a finger plate 86 that cooperates with a complementary slot 93 (see FIG. 7A) provided in a proximal end portion 44 of the sighting rib.

In order to lock together connector portions 60 and 62 at a selected relative position, plunger 82 is seated against a coil steel spring 84 within a bore 87 (see FIG. 30) within finger tab 68. In assembly, a top end of plunger 82 is seated against a bottom surface of finger 86 and top surface of plunger 82 slides along finger 86 as a user grasps recessed faces 134 on opposite sides of finger tab 68, upwardly urging finger tab 68 and compressing spring 84 sufficiently to disengage arcuate projections 92 and 94 to facilitate forward or reverse movement of the sighting rib 26 relative to base plate 66 of rear support bracket 42. Upon releasing finger tab 68, arcuate projections 92 and 94 seat in a new relative position, thereby locking the kinematically articulated position of sighting rib 26 relative to the shotgun barrel that is rigidly affixed onto mounting interface 58. In this manner, a pitch angle of a top surface on sighting rib 26 can be adjusted to any one of a plurality of specific preselected orientations through actuation of latch mechanism 34. This movement articulates the associated pitch adjustment mechanism 32 (see FIG. 2) to achieve a desired pitch angle for a top sighting surface on sighting rib 26. During assembly, plunger 80 and spring 84 are inserted into a bore 87 (see FIG. 30) in finger tab 68, after which plunger 82 is received against a bottom surface of finger 86, and during which pins (such as pin 51) are urged into respective apertures (such as apertures 81). Pin 51 is pressed bit through a first aperture 81, passing through cam slot 75 and into a second aperture 81. Preferably, an adhesive, such as Loctite® is provided along an outer surface of pin 51 prior to inserting pin into apertures 81 and slot 75. Accordingly, pin 51 in assembly, is rigidly and adhesively affixed into apertures 81, while precise fit sliding action is provided between pin 51 and cam slot 75 during adjustment. Remaining pins 46-50 are similarly received into apertures 76-80, respectively (see FIG. 3).

Figure 6:
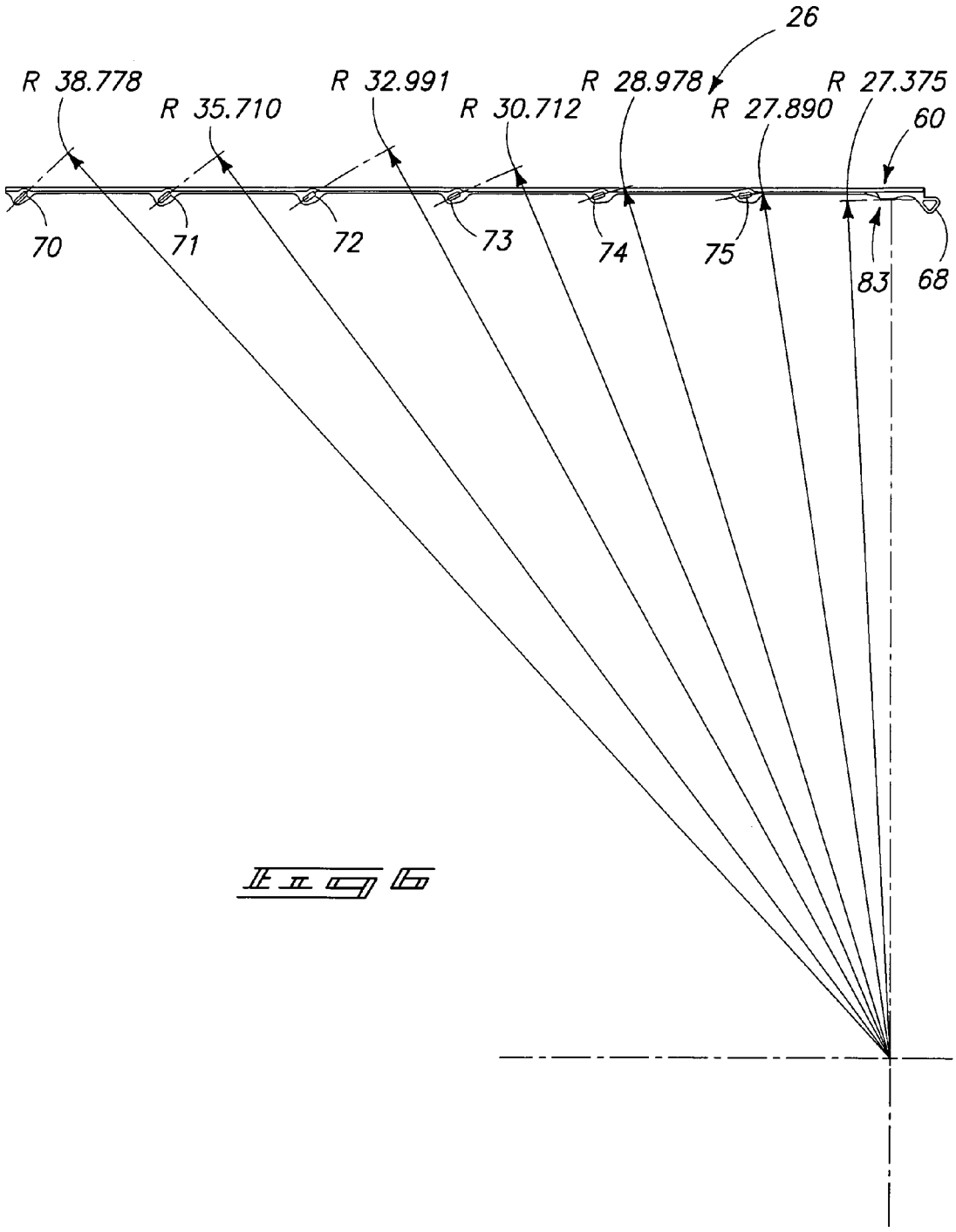
FIG. 6 is a side view of a sighting rib from the adjustable gun sight of FIGS. 1-5.

In order to achieve a desired kinematic motion between the sighting rib 26 and rib support member 30 (of FIGS. 1 and 2), the cam slots 70-75 (see FIGS. 3-5) are arcuate, being formed with a relatively large radius generally in a range comparable to a length of the shotgun barrel. More particularly, FIG. 6 illustrates the radius for a center pin position corresponding with each cam slot 70-75. Additionally, first connector portion 60 (as well as second connection portion 62, see FIG. 5) are also constructed with a radius that is formed from the same generating point as the radiuses used to form the cam slot 70-75. The radius value for generating each cam slot and connector portion 60 are shown in FIG. 60, with values being shown in inches. The radius shown for complementary surface 83 corresponds with a center position formed between the projections on surface 83 as they mesh together in engagement with projections on surface 85 (see FIG. 5) when interlocked together. Each cam slot 70-75 forms a pair of substantially parallel cam surfaces.

Figure 6A:
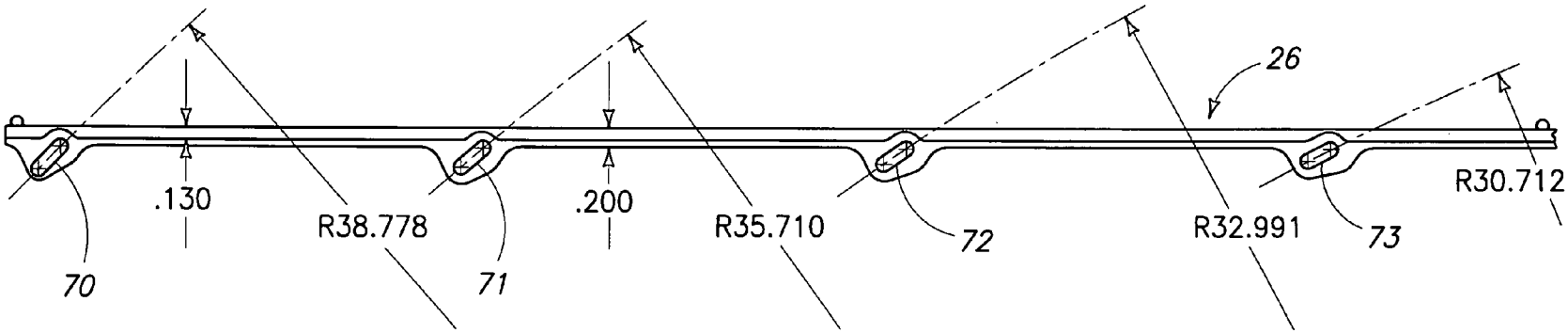
FIGS. 6A and 6B are enlarged side view portions of the sighting rib broken apart and corresponding with the side view of FIG. 6.
Figure 6B:
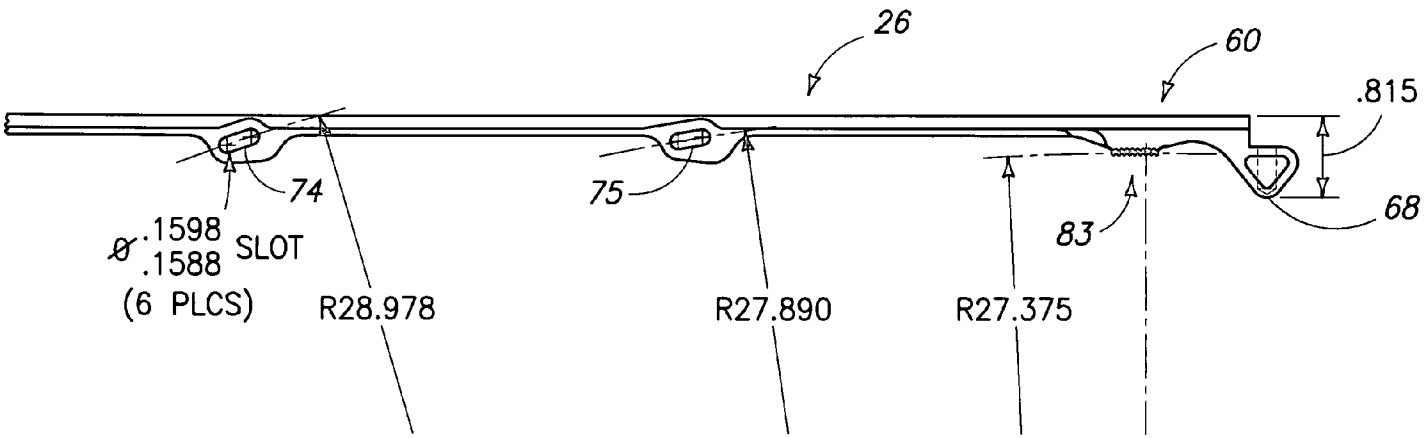
Figure 11:
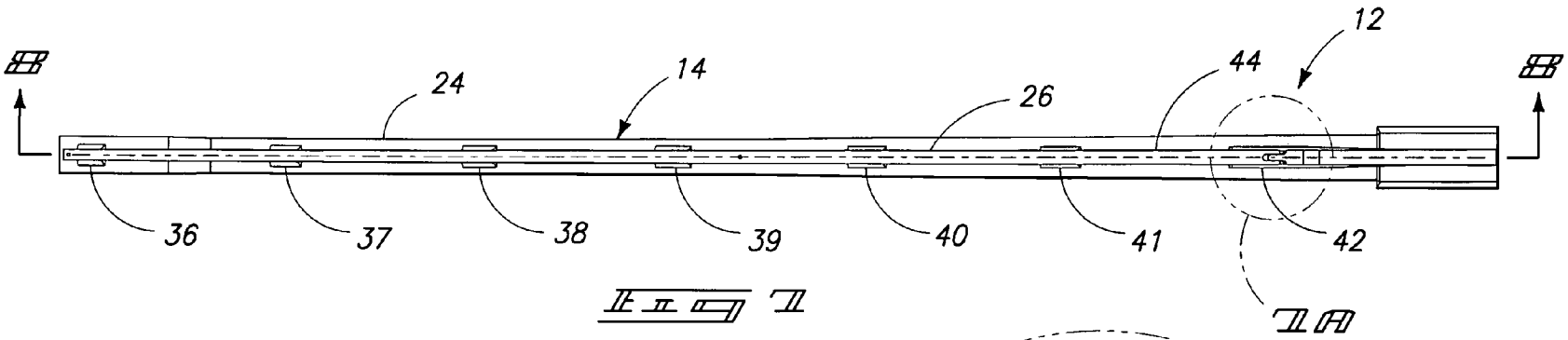
Figure 11A:
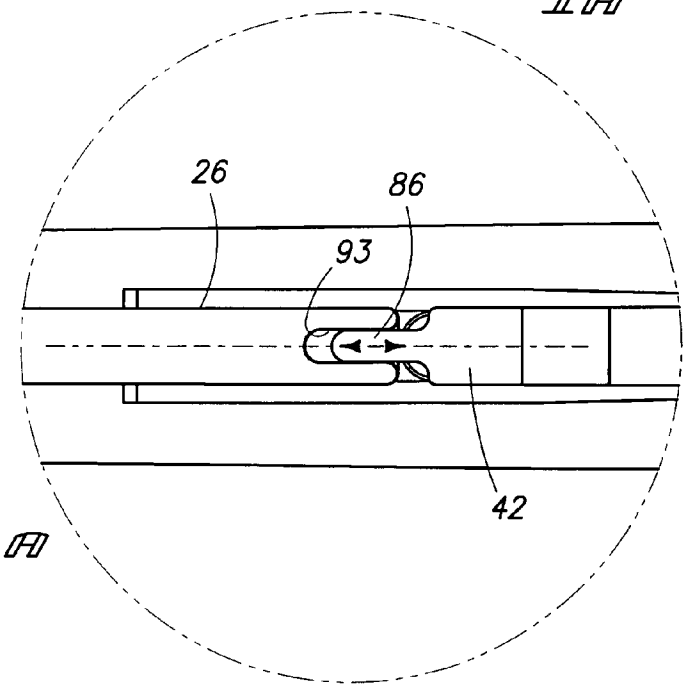

FIGS. 6A and 6B together show the generating radiuses for each of cam slots 70-75, as well as surface 83 for sighting rib 26. The radial dimensions and nominal thicknesses depicted in FIGS. 6A and 6B are shown in inch units. According to such one exemplary construction, sighting rib 26 is constructed with an overall length of 29.432 inches, including the lengthwise dimension of finger tab 86. However, it is understood that other suitable dimensions and constructions can be utilized. One desirable benefit provided by having a large array of cam slots 70-75 is the ability to form sighting rib 26 with a relatively shallow vertical cross-sectional dimension which substantially reduces windage when shooting a shotgun outdoors under windy conditions. Such a provision of a relatively low-windage shotgun and gun sight can be highly desirable to competition shooters. Such a configuration can clearly be seen in FIGS. 1 and 8. Furthermore, the relatively large gap provided between sighting rib 26 and a shotgun barrel, in assembly, significantly reduces heat transfer to sighting rib 26 which can otherwise create heat mirages that otherwise affect the shooter's ability to align and sight the shotgun while shooting.

As shown in FIGS. 6 and 6A, 6B, cam slots 70-75 have a progressively steeper slope when moving from a breach end of the gun towards a muzzle end of the gun. Accordingly, brackets 52-57 have a correlated array of cam slots 70-75 of progressively decreasing slope. Accordingly, for a given amount of axial displacement between sighting rib 26 and support bracket 42 (see FIGS. 2-3), a progressively greater amount of vertical lift (or drop) is imparted to the muzzle end of sighting rib 26 than is imparted to the breach end of sighting rib 26. Accordingly, the pitch angle of the top surface of sighting rib 26 is varied by moving the relative position of sighting rib 26 fore-and-aft relative to support bracket 42.

FIG. 7 illustrates adjustable gun sight 12 mounted atop barrel 24 of barrel assembly 14, in plan view. Pickets 36-41 and support bracket 42 are substantially equally spaced apart along barrel 24 in order to provide for rigid support of sighting rib 26 while still maintaining a relatively thin profile section on sighting rib 26. Proximal end portion 44 of sighting rib 26 cooperates with rear support bracket 42 to prevent lateral displacement of sighting rib 26 relative to support bracket 42, while providing for relative axial movement therebetween when adjusting the pitch position of sighting rib 26 relative to support bracket 42.

More particularly, FIG. 7A illustrates the cooperation of sighting rib 26 with rear support bracket 42. An elongate finger 86 is provided by support bracket 42 which fits in close-fitting (or snug), sliding engagement within a complementary elongated slot 93 provided in an end portion of sighting rib 26. Finger 86 and slot 93 are sized so as to prevent any lateral motion between support bracket 42 and sighting rib 26, thereby providing lateral stability to sighting rib 26. However, finger 86 is designed to smoothly and snugly slide within slot 93 over the entire range of motion between sighting rib 26 and support bracket 42 which is imparted when adjusting the pitch positions provided for sighting rib 26 relative to a gun barrel.

Figures 8, 9A:
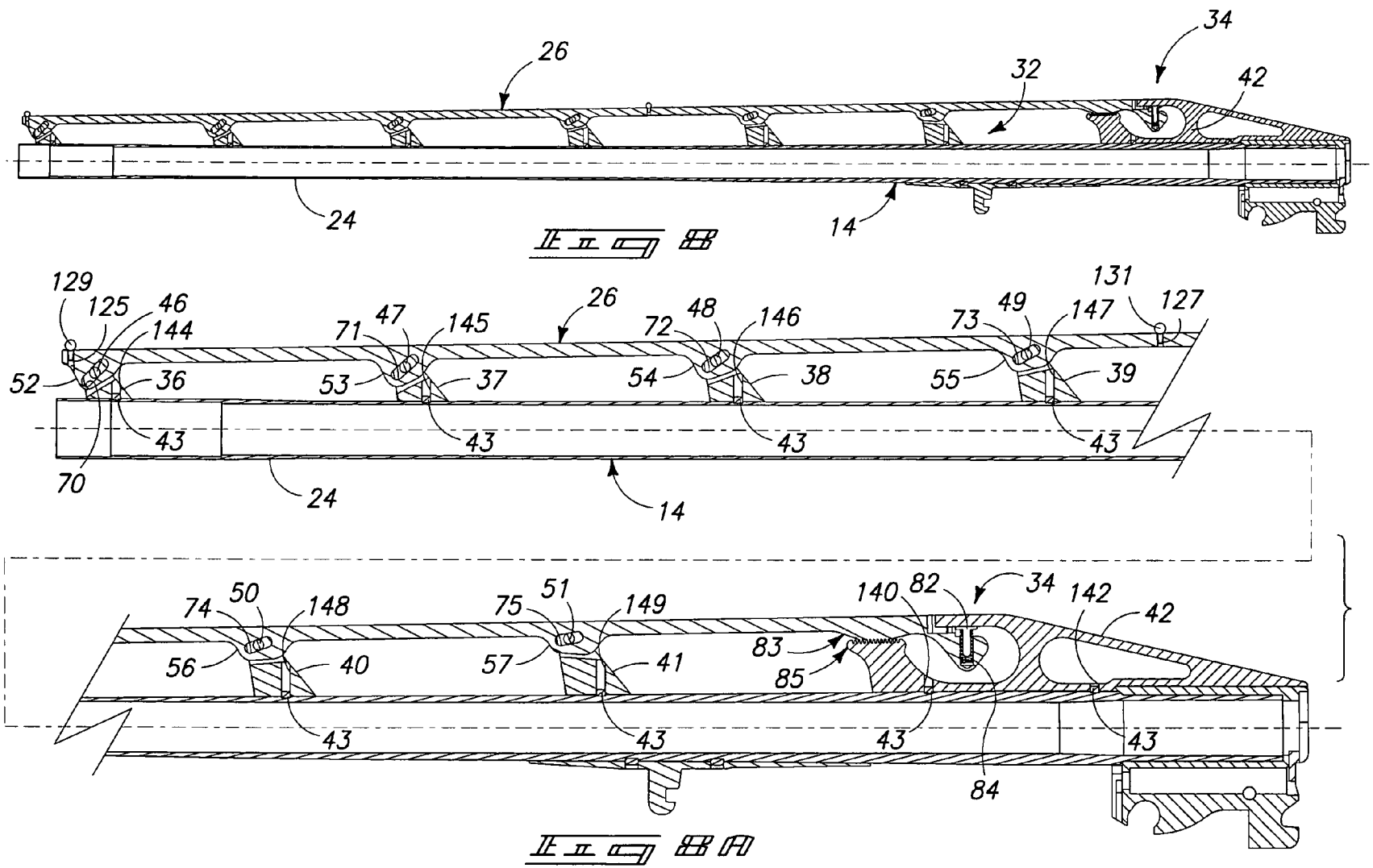
FIG. 8 is a vertical sectional view of the adjustable gun sight and barrel taken along line 8-8 through a center bore of the barrel of FIG. 7.

FIGS. 8 and 8A illustrate barrel 24 of barrel assembly 14 and sighting rib 26 in vertical centerline-sectional view with pitch adjustment mechanism 32 and latch mechanism 34 positioned to provide an 80-20 shot spread at 35 yards shot distance. As shown in FIG. 8A, sighting rib 26 carries a pair of sighting beads 129 and 131, each of which is retained in a respective bore 125 and 127 within sighting rib 26. According to one construction, bores 125 and 127 are tapped with threads and each sighting bead 129 and 131 has a tapered plastic base plug that is downwardly forced into the respective threaded bore 125 and 127. Optionally, sighting beads can be affixed through any presently known fastening system, or can be eliminated all together.

In addition to being adhesively bonded atop barrel 24, each picket 36-41 and support bracket 42 includes a bore 144-149 and 140, 142 which aligns with a complementary cylindrical bore in the barrel 24. See, for example, bore 69 in FIG. 29. Bore 69 is 0.0020" in depth into barrel 24 with a flat end. A pin 43 is inserted into each bore 144-149 and 140, 142 and into each respective bore in barrel 24, subsequent to affixing pickets 3641 and support bracket 42 onto barrel 24. The adhesive further retains each pin, with the pins cooperating in the bores to further retain pickets 36-41 and bracket 42 atop barrel 24. According to one construction, pin 43 is 3/32" in length and 1/8" in diameter. The bore is slightly oversized by 0.001" diameter to facilitate assembly.

Brackets 52-57 of sighting rib 26 each includes a respective cam slot 70-75 as shown in FIG. 8A. Respective pin 46-51 is shown within each slot 70-75 corresponding with a pitch angle for sighting rib 26 that corresponds with an 80-20 shot split (relative to barrel 24 at 35 yards). According to one construction, pins 46-51 each have a 5/32" diameter (0.15625"), cam slots 70-75 have a radial width of minimum 0.1598" and maximum 0.1588", and apertures 76-81 (see FIG. 4) in pickets 36-41 each have a diameter of minimum 0.1585" and maximum 0.1570". According to such one construction, pins 46-51 are steel dowel rod pins, pickets 36-41 (and support bracket 42) are made from steel that is blued, and sighting rib 26 is constructed from anodized 6061 aluminum alloy. Alternatively, other constructions are suitable.

Figure 9:
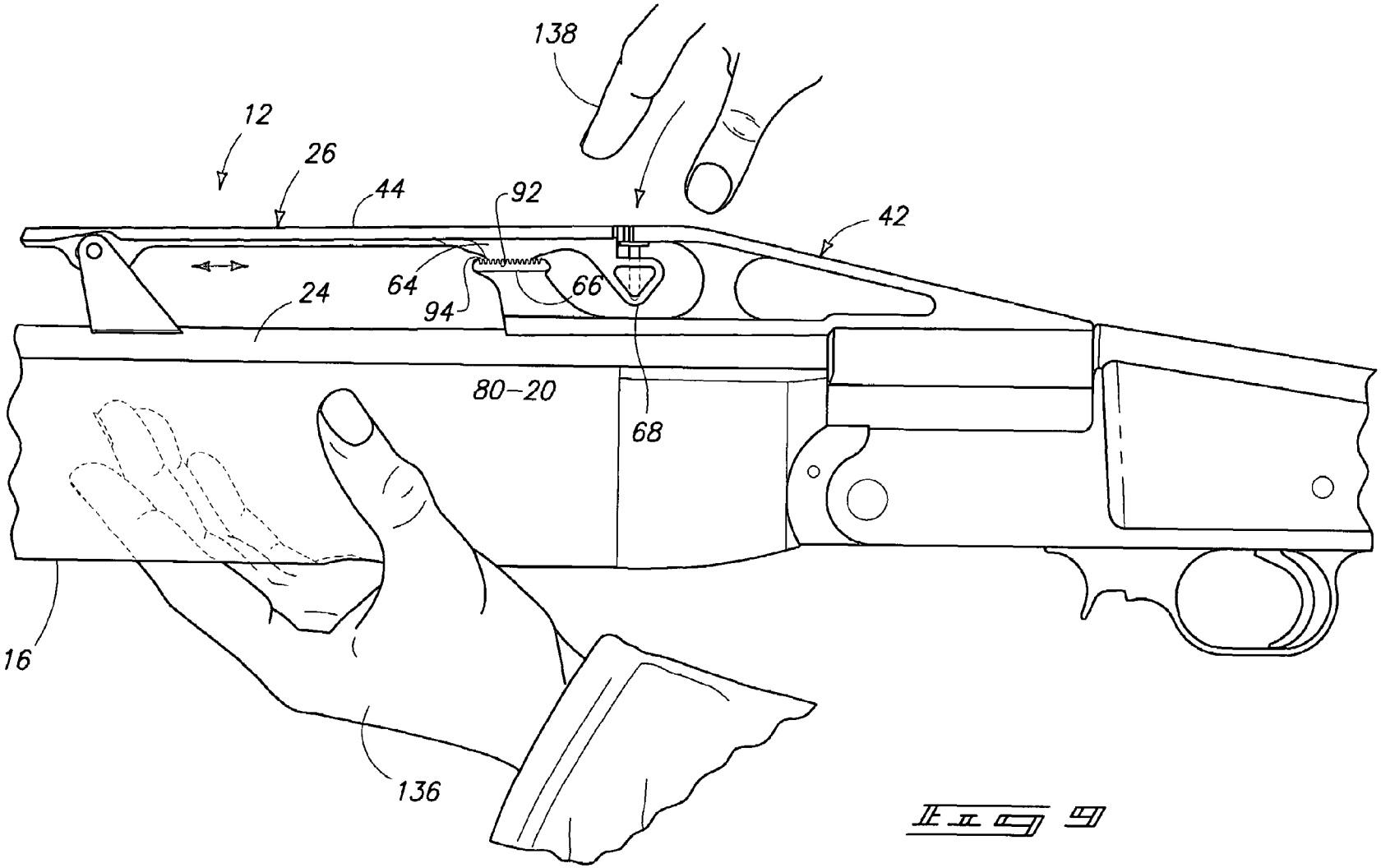
FIG. 9 is a partial, enlarged side view of the adjustable gun sight and gun of FIG. 1 illustrating a user prior to adjusting positioning of the sighting rib on the adjustable gun sight to adjust pitch of the sighting rib relative to the gun barrel and corresponding with the sighting rib positioned for an 80-20 shot spread.
Figure 11:
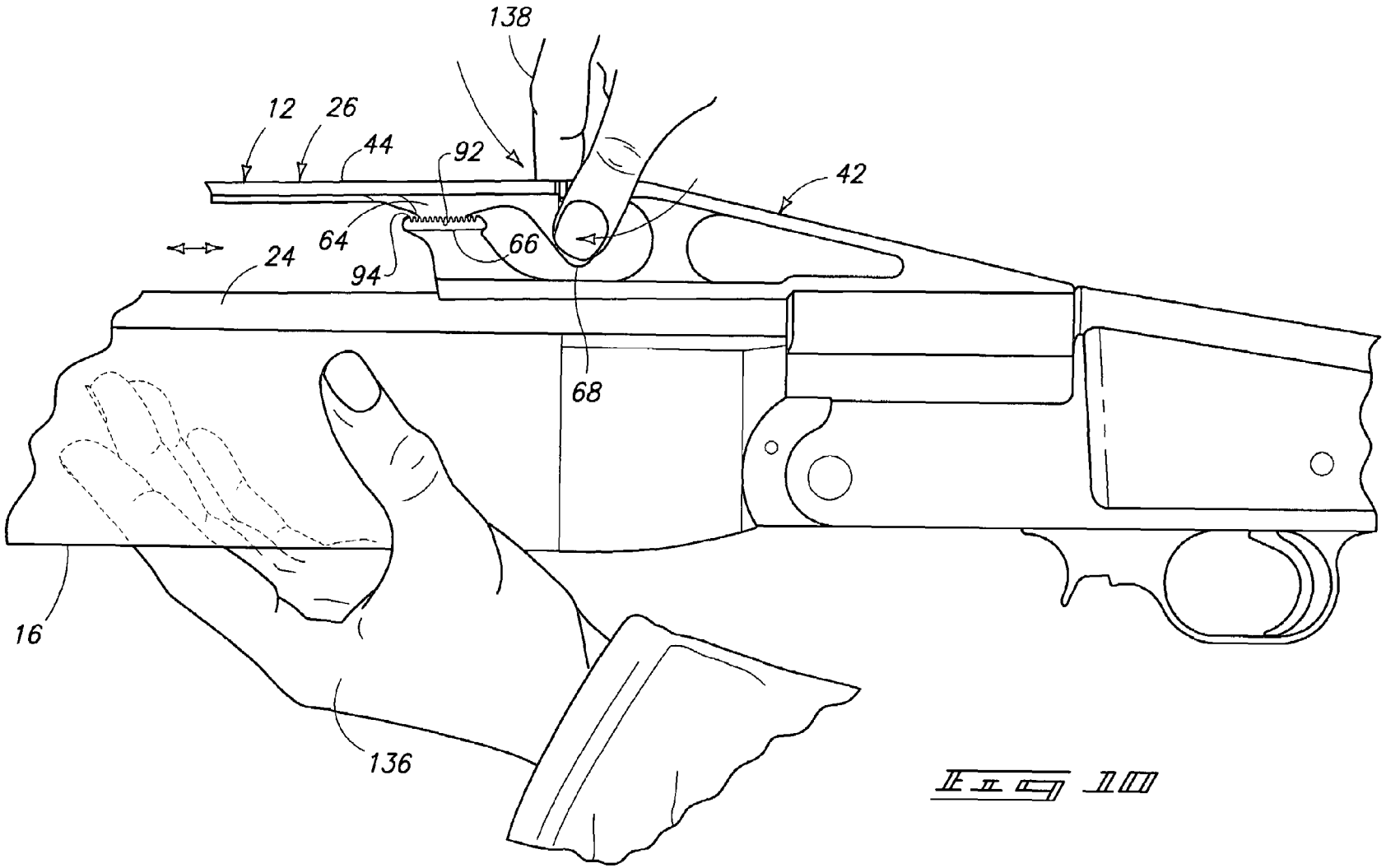
Figure 11:
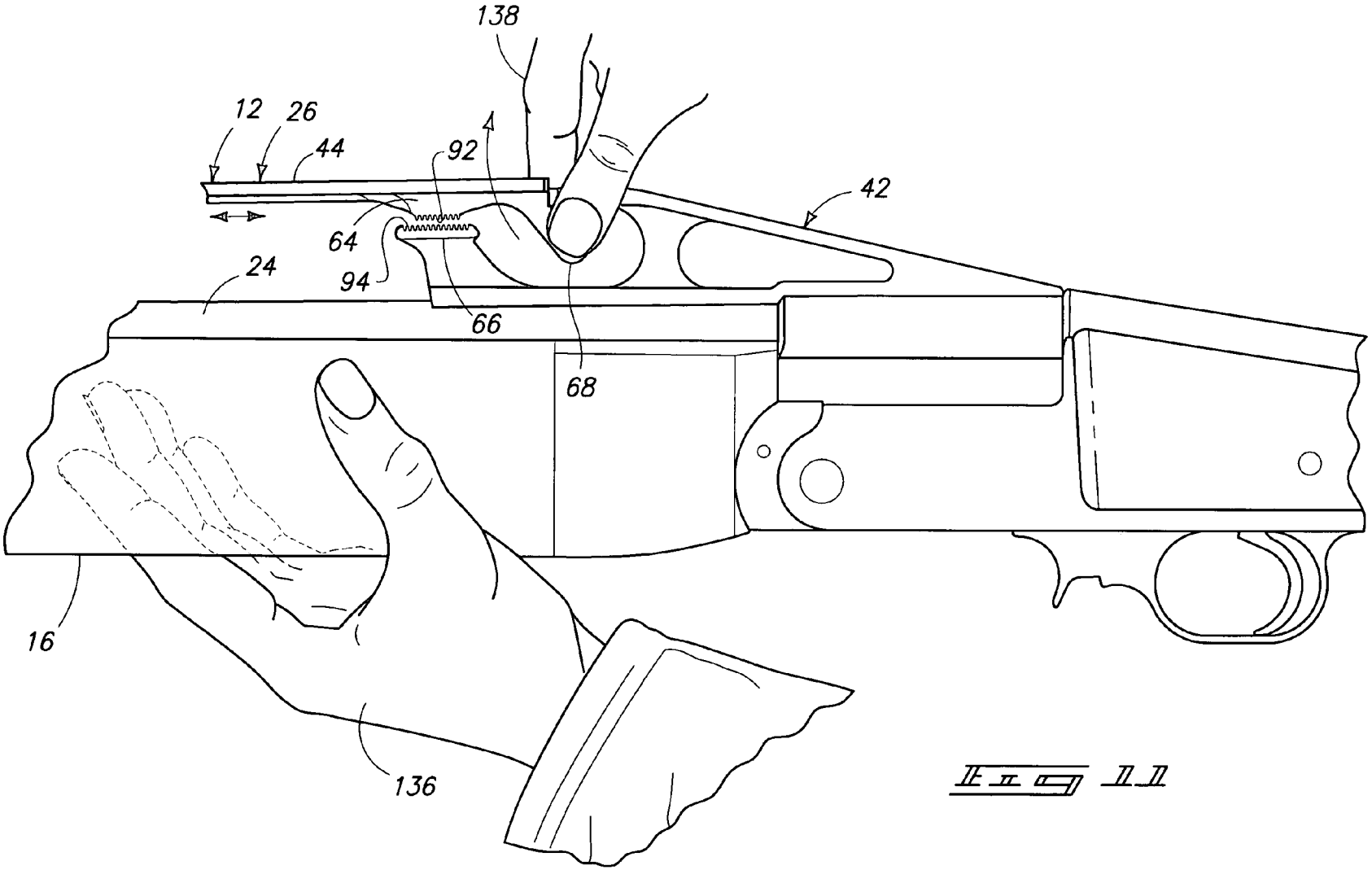

FIG. 9 illustrates a user prior to adjusting positioning of sighting rib 26 on adjustable gun sight 12 to adjust pitch of sighting rib 26 relative to gun barrel 24 and corresponding with sighting rib 26 positioned for an 80-20 shot spread. More particularly, stock 16 is gripped with a user's left hand 136, while the user's right hand 138 reaches down to grasp finger tab 168 in order to lift up tab 168 in order to upwardly flex end portion 44 (relative to bracket 42) like a cantilever spring to disengage the plurality of engaged, repeating projections 92 and 94 on base plates 64 and 66, respectively.

FIG. 10 illustrates a user grasping finger tab 68 with their fingers of hand 138 prior to disengaging projections 92 and 94 on base plates 64 and 66, respectively, in order to slide plates 64 and 66 relative to one another to set a new shot spread (and achieve a new pitch angle between sighting rib 26 and barrel 24).

Figure 11:
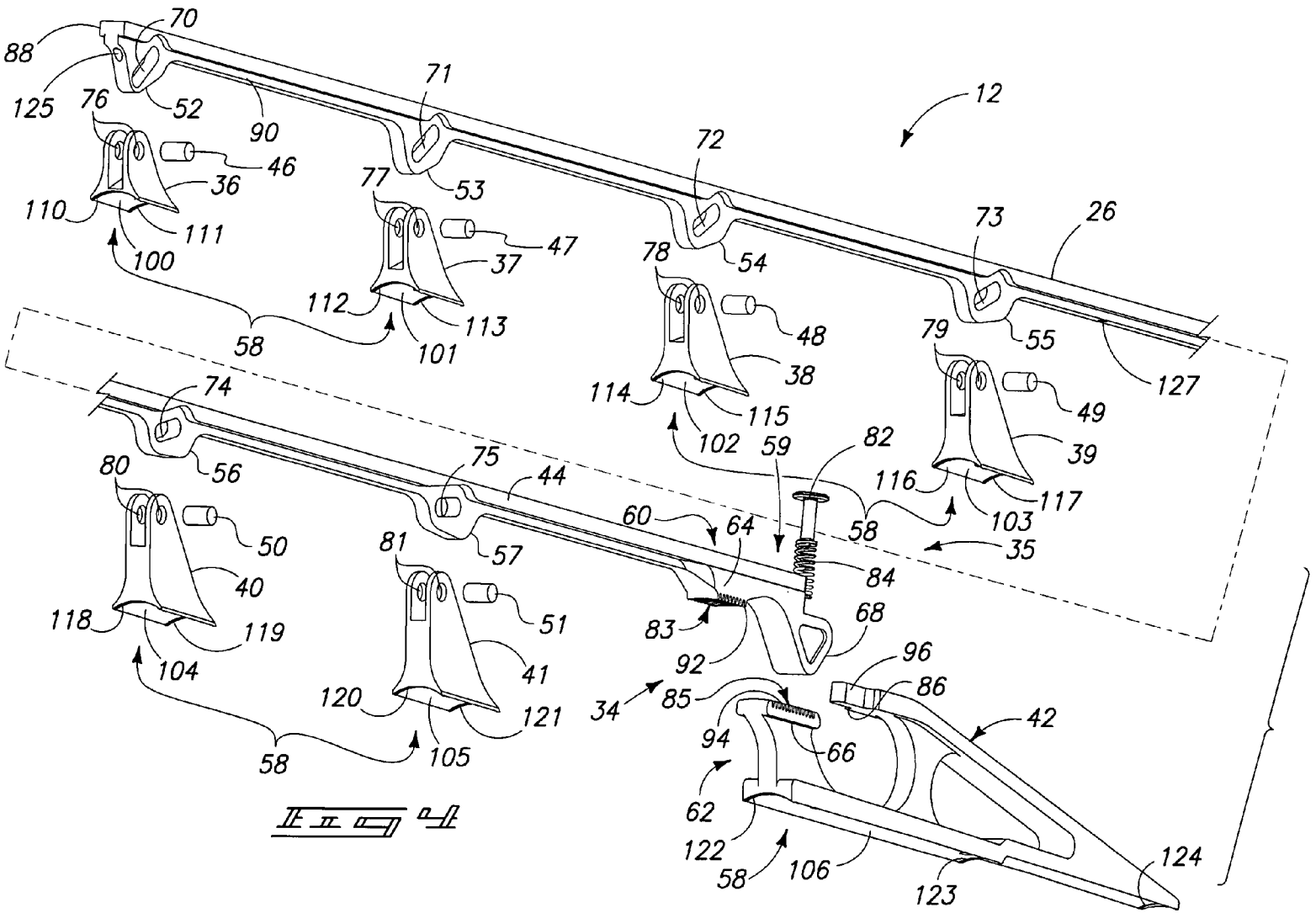
FIG. 11 is a partial, enlarged side view of the adjustable gun sight and gun of FIG. 1 illustrating a user urging the finger tab upwardly to disengage the latch mechanism and reposition the sighting rib relative to the barrel to adjust pitch of the sighting rib relative to the barrel.

FIG. 11 illustrates a user upwardly urging finger tab 68 via hand 138 so as to disengage the latch mechanism by repositioning plates 64 and 66 to new overlapping positions that will re-engage projections 92 and 94 in a new interlocking configuration corresponding with a new shot spread via new pitch angle for sighting rib 26 relative to barrel 24.

Figures 12, 12A, 12B:
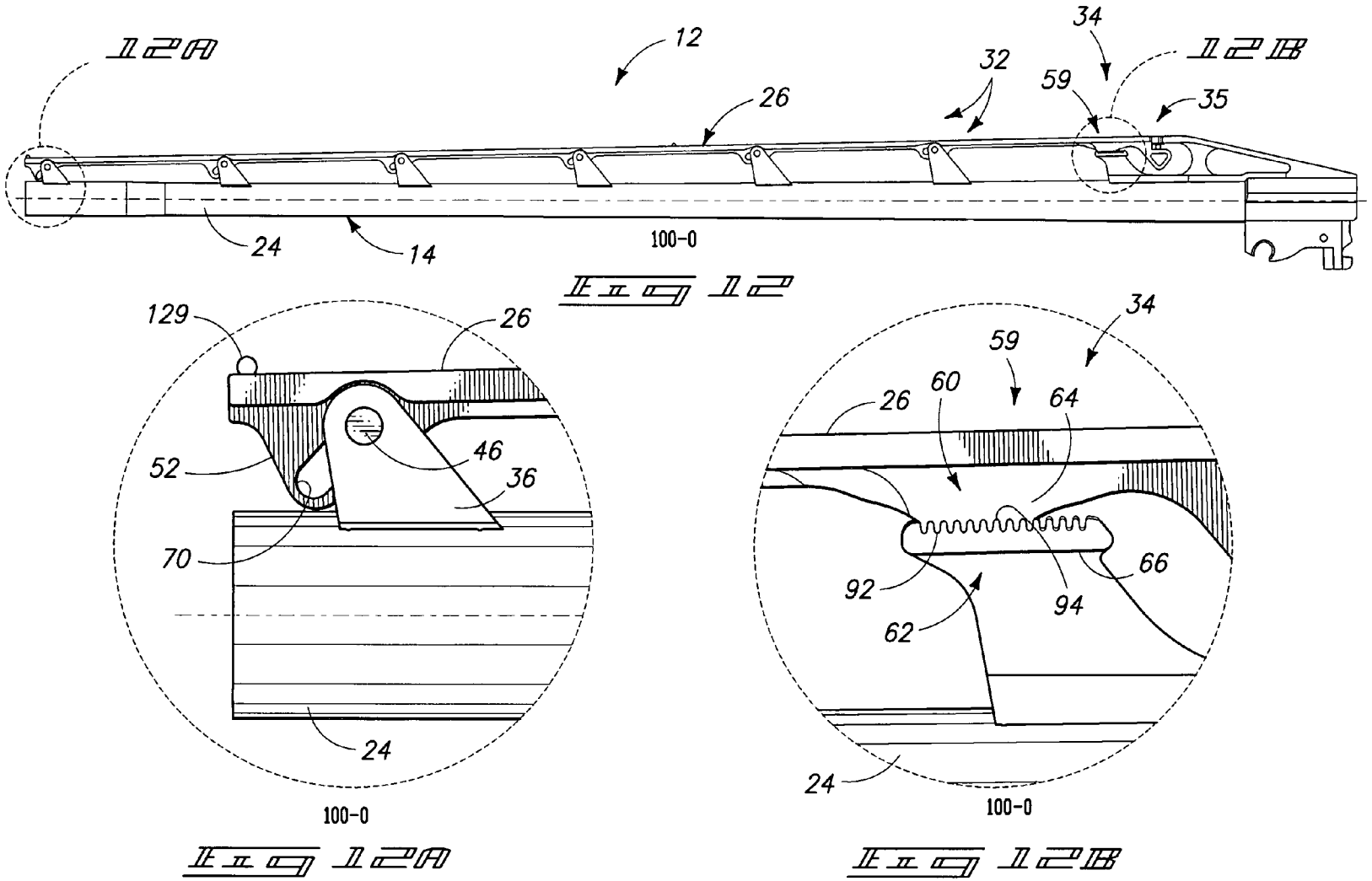
FIG. 12 is a side view of the adjustable gun sight and barrel depicted in FIG. 7 positioned for a 100-0 shot spread.
FIG. 12A is an enlarged view of a distal picket and bracket from a pitch adjustment mechanism of the adjustable gun sight taken from the encircled region 12A of FIG. 12.
FIG. 12B is an enlarged view of an engaged first connector portion and second connector portion for a latch mechanism of the adjustable gun sight taken from the encircled region 12B of FIG. 12.
Figures 1A, 1B, 1C, 1D, 1E:
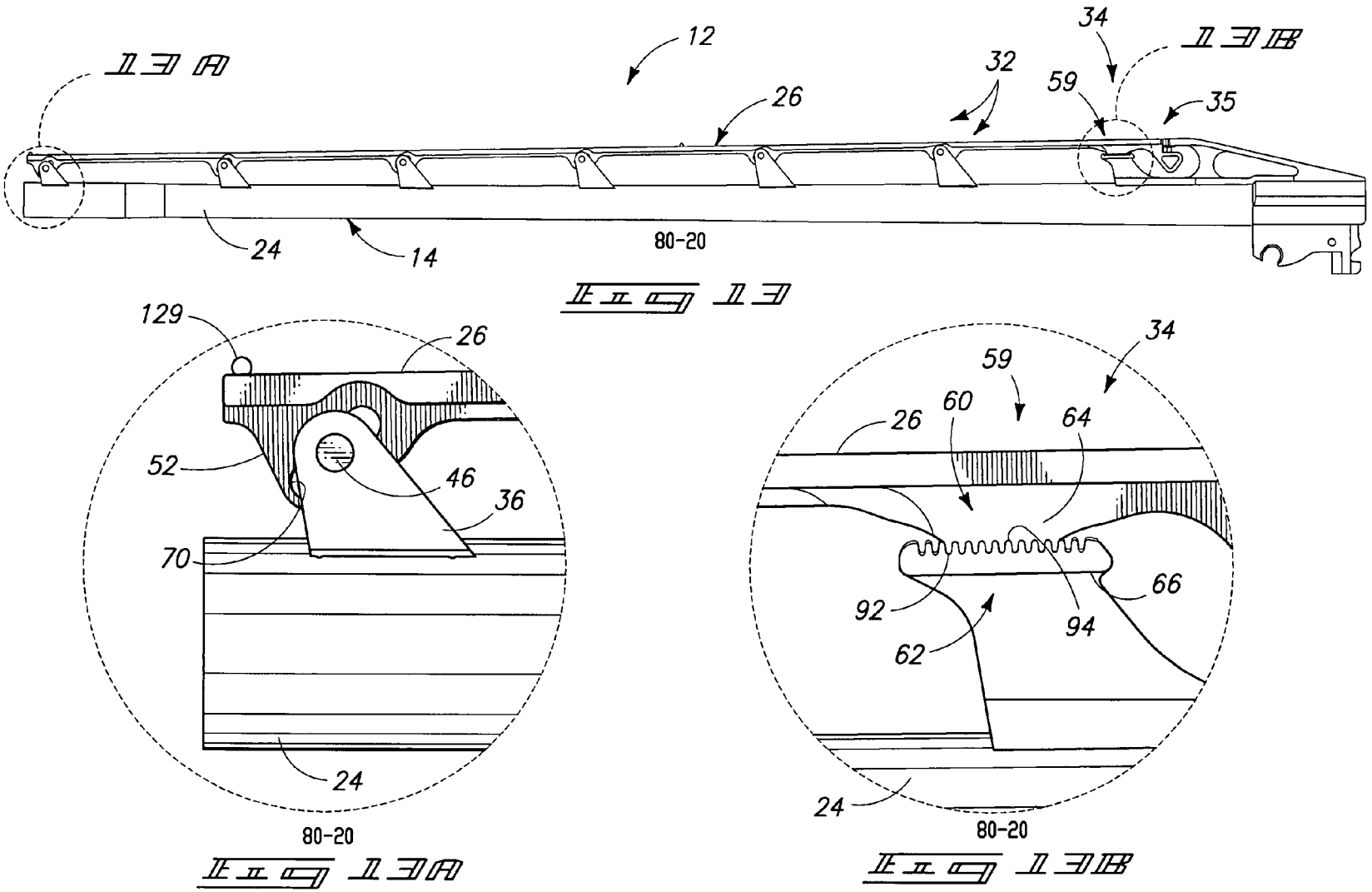
Figure 11:
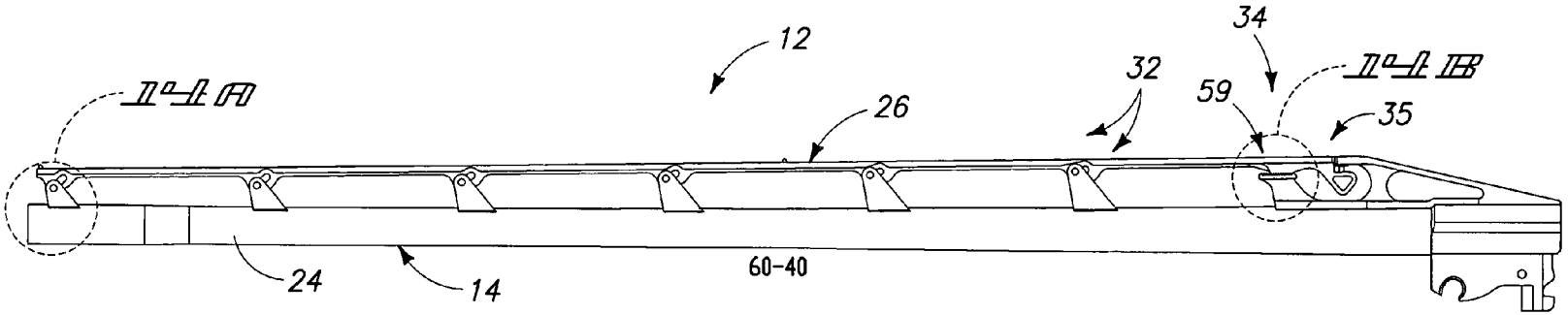
Figure 11B:
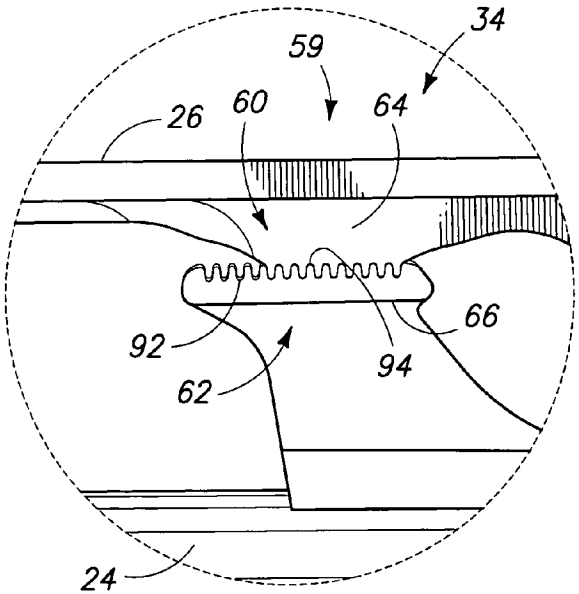
Figure 11A:
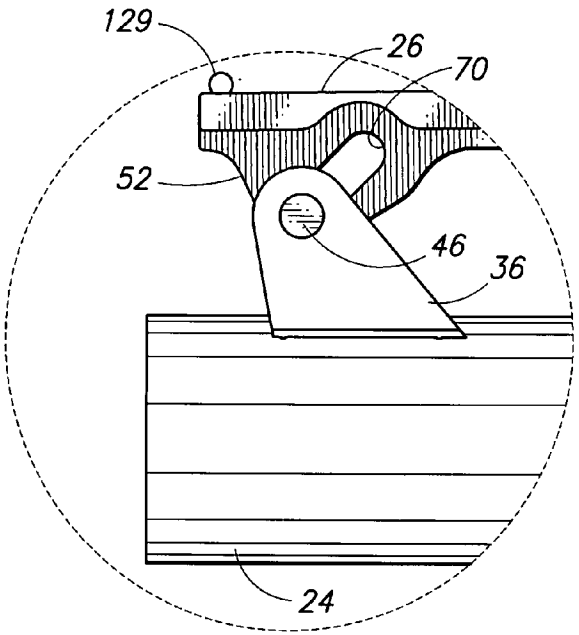

FIG. 12 is a side view of adjustable gun sight 12 and barrel 24 as depicted in FIG. 7 and shown positioned for a 100-0 shot spread (at 35 yards) via kinematic articulation of pitch adjustment mechanism 32. It is understood that connector 59 of latch mechanism 34 on adjustable gun sight 12 can be selectively positioned into any one of five pitch angles for sighting rib 26 relative to barrel 24; namely, pitch positions that correspond with 100-0, 90-10, 80-20, 70-30 and 60-40 shot spreads. Spring lock 35 serves to hold the selected pitch angle until a user manipulates latch mechanism 34 as previously discussed with reference to FIGS. 9-11 above. Each position modifies the center of the shot spread approximately 2.5" in height at 35 yards distance.

FIG. 12A shows the articulated position of distal picket 36 (on barrel 24) and bracket 52 (of sighting rib 26) resulting from the articulated position of sighting rib 26 relative to barrel 24 as taken from the encircled region 12A of FIG. 12.

FIG. 12B shows the articulated position of engaged first connector portion 60 and second connector portion 62 for connector 59 of latch mechanism 34 on the adjustable gun sight taken from the encircled region 12B of FIG. 12. Projections 92 and 94 are shown in a corresponding interlocked position where base plates 60 and 62 are pressed together via cantilever spring action of rib 26 and spring 84 (see FIG. 5).

FIG. 13 is a side view of adjustable gun sight 12 and barrel 24 as depicted in FIG. 7 and shown positioned for an 80-20 shot spread via kinematic articulation of pitch adjustment mechanism 32. Spring lock 35 serves to hold the selected pitch angle until a user manipulates latch mechanism 34 as previously discussed with reference to FIGS. 9-11 above.

FIG. 13A shows the articulated position of distal picket 36 (on barrel 24) and bracket 52 (of sighting rib 26) resulting from the articulated position of sighting rib 26 relative to barrel 24 as taken from the encircled region 13A of FIG. 13.

FIG. 13B shows the articulated position of engaged first connector portion 60 and second connector portion 62 for connector 59 of latch mechanism 34 on the adjustable gun sight taken from the encircled region 13B of FIG. 13. Projections 92 and 94 are shown in a corresponding interlocked position where base plates 60 and 62 are pressed together via cantilever spring action of rib 26 and spring 84 (see FIG. 5).

FIG. 14 is a side view of adjustable gun sight 12 and barrel 24 as depicted in FIG. 7 and shown positioned for a 60-40 shot spread via kinematic articulation of pitch adjustment mechanism 32. Spring lock 35 serves to hold the selected pitch angle until a user manipulates latch mechanism 34 as previously discussed with reference to FIGS. 9-11 above.

FIG. 14A shows the articulated position of distal picket 36 (on barrel 24) and bracket 52 (of sighting rib 26) resulting from the articulated position of sighting rib 26 relative to barrel 24 as taken from the encircled region 14A of FIG. 14.

FIG. 14B shows the articulated position of engaged first connector portion 60 and second connector portion 62 for connector 59 of latch mechanism 34 on the adjustable gun sight taken from the encircled region 14B of FIG. 14. Projections 92 and 94 are shown in a corresponding interlocked position where base plates 60 and 62 are pressed together via cantilever spring action of rib 26 and spring 84 (see FIG. 5).

Figures 15, 16:
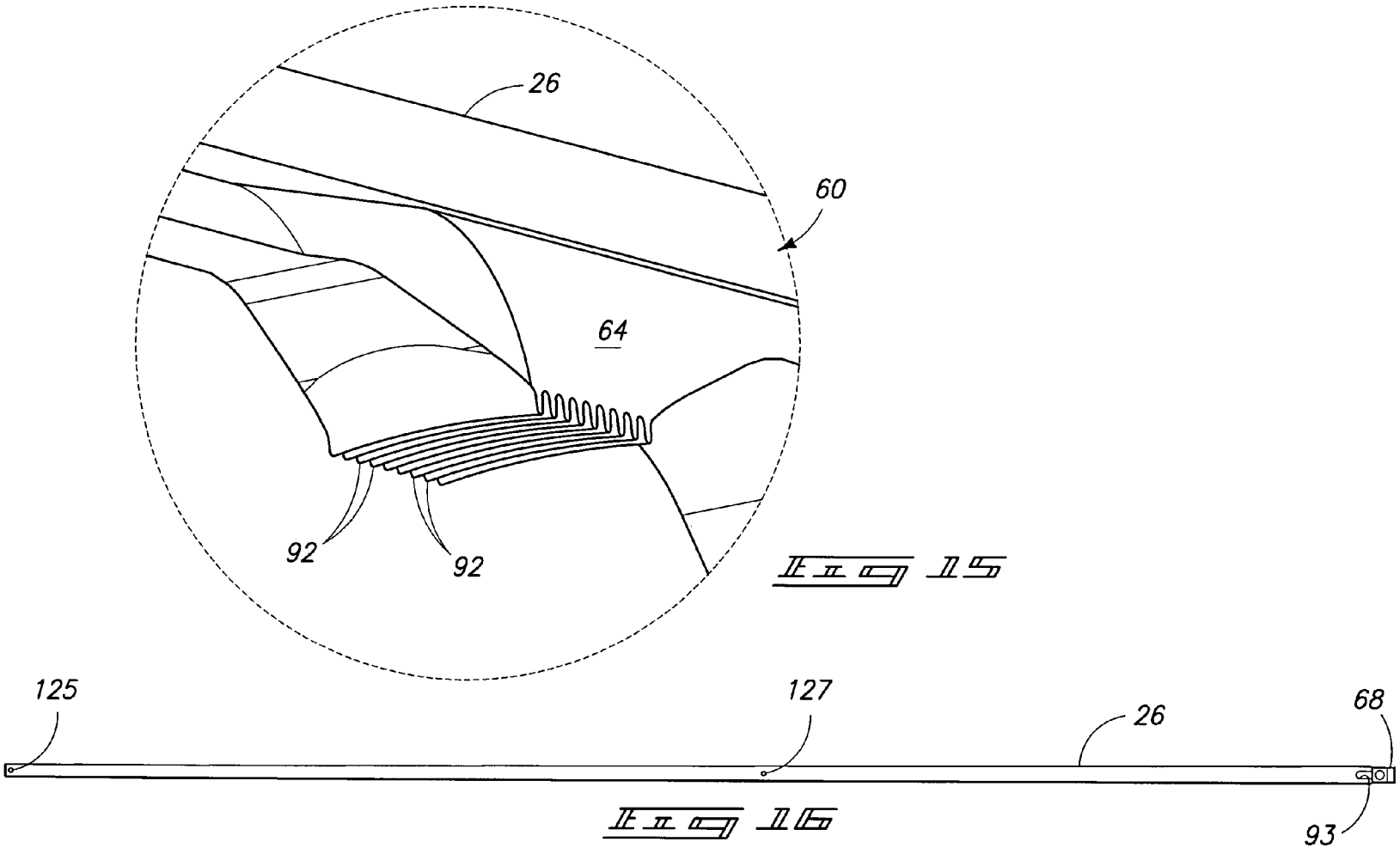
FIG. 15 is an enlarged perspective view taken from below of the first connector portion on the sighting rib.
FIG. 16 is a plan view taken from above of the sighting rib.
Figure 11:
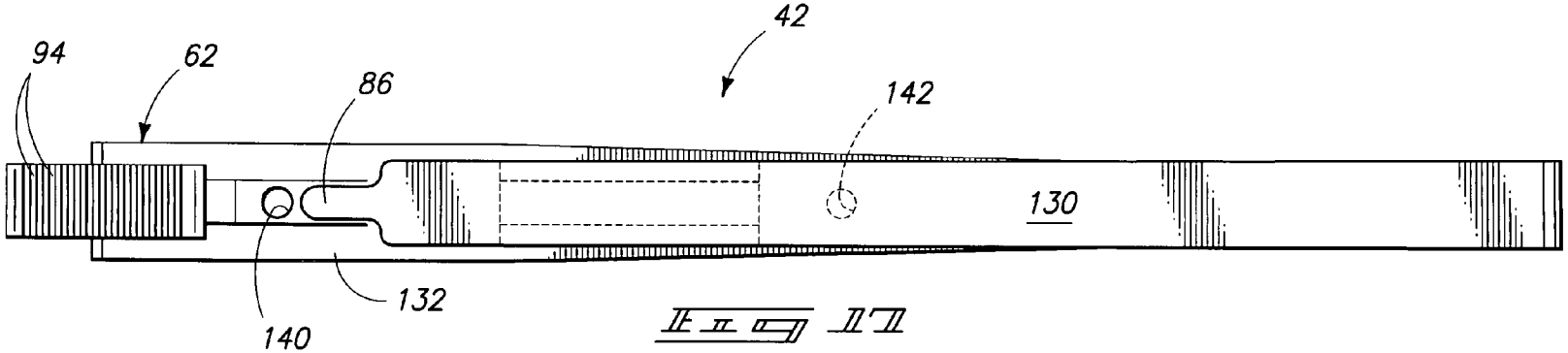
Figure 11B:
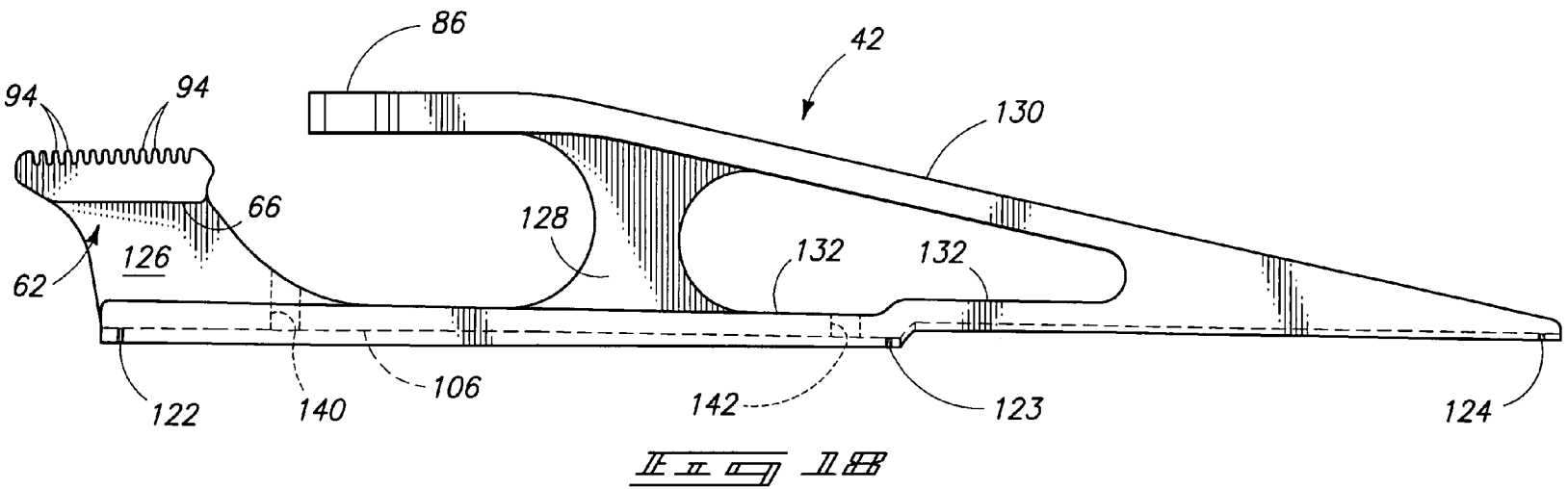
Figure 11:
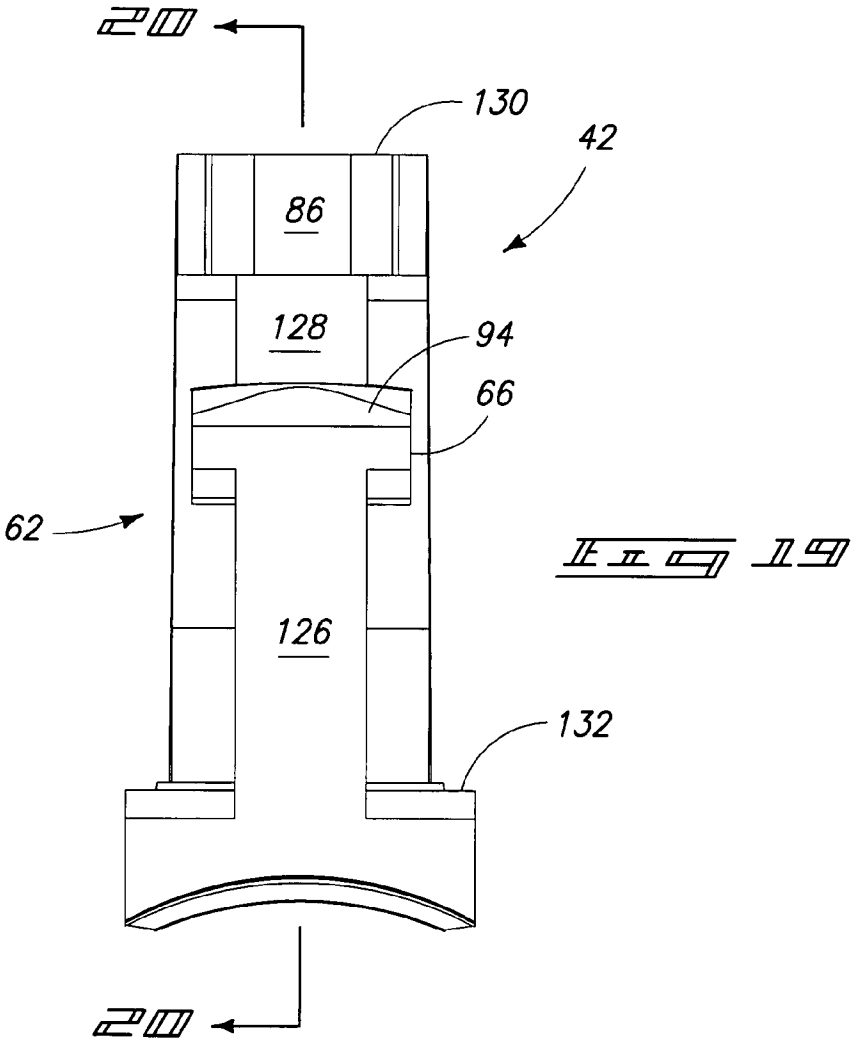

FIG. 15 illustrates one construction for projections 92, wherein each projection comprises an arcuate projection, or tooth, having a radial configuration. Such construction can be machined using a lathe. Accordingly, complementary mating projections 92 and 94 are configured to selectively interlock in three dimensions. Complementary mating projections 94 (see FIGS. 12-14) are similarly constructed, according to the one embodiment. Alternatively projections 92 and 94 can be formed from linear projections, and can have alternative interlocking features, such as square teeth, or other alternative selectively interlocking configurations. Arcuate projections 64 are machined into base plate 64 which is integrally formed from sighting rib 26 to provide first connector portion 60.

FIG. 16 shows one suitable construction for sighting rib 26 with apertures 125 and 127 provided in spaced part relation relative to finger tab 68 and slot 93.

FIGS. 17-21 further illustrate one construction for rear support bracket 42. As shown in FIGS. 17-19, apertures 140 and 142 are spaced apart in bottom plate 132. Likewise, adhesive risers 122-124 are also spaced apart along adhesive surface 106 of bottom plate 132, as shown in FIG. 18. Construction details of finger 86 can also be seen in FIGS. 17-19, as finger 86 is integrally formed from top plate 130.

A sequential array of arcuate projections 94 are clearly shown atop base plate 66 so as to form second connection portion 62 of support bracket 42, as shown in FIGS. 17-19. Base plate 66 is formed integrally atop rib 126. Similarly, finger 86 is formed integrally from top plate 130 in relatively rigid, affixed relation depending from rib 28 which is rigidly and integrally formed with bottom plate 132, as shown in FIG. 18.

Further details of support bracket 42 are shown with respect to FIGS. 20-21. In FIG. 20, the location of bores 140 and 142 and arcuate adhesive risers 122-124 are clearly shown. A layer of adhesive glue is provided between risers 122-124. Furthermore, glue is provided within bores 140 and 142, prior to inserting pins 43 (see FIG. 8A). FIG. 21 further illustrates the construction of one exemplary adhesive riser 123 which forms an arcuate rib that seats support bracket 42 atop a gun barrel with a desirable spacing of adhesive provided therebetween. FIG. 22 further illustrates the orientation of arcuate projection 94 in relation to rib 126 and adhesive riser 122.

Figure 23:
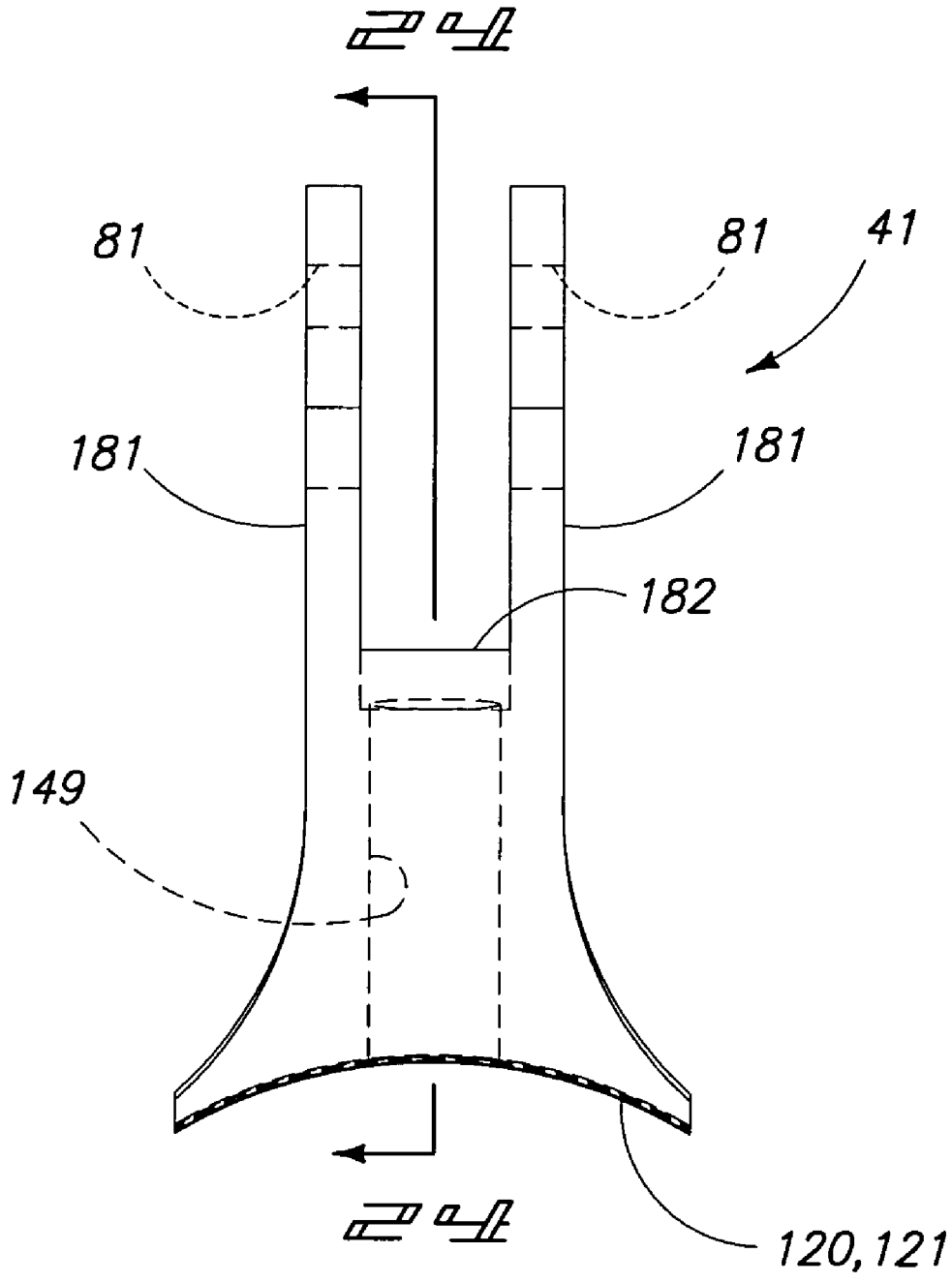
FIG. 23 is a left end view of a picket closest to the breech end of the barrel for the adjustable gun sight of FIGS. 1-22.
Figure 24:
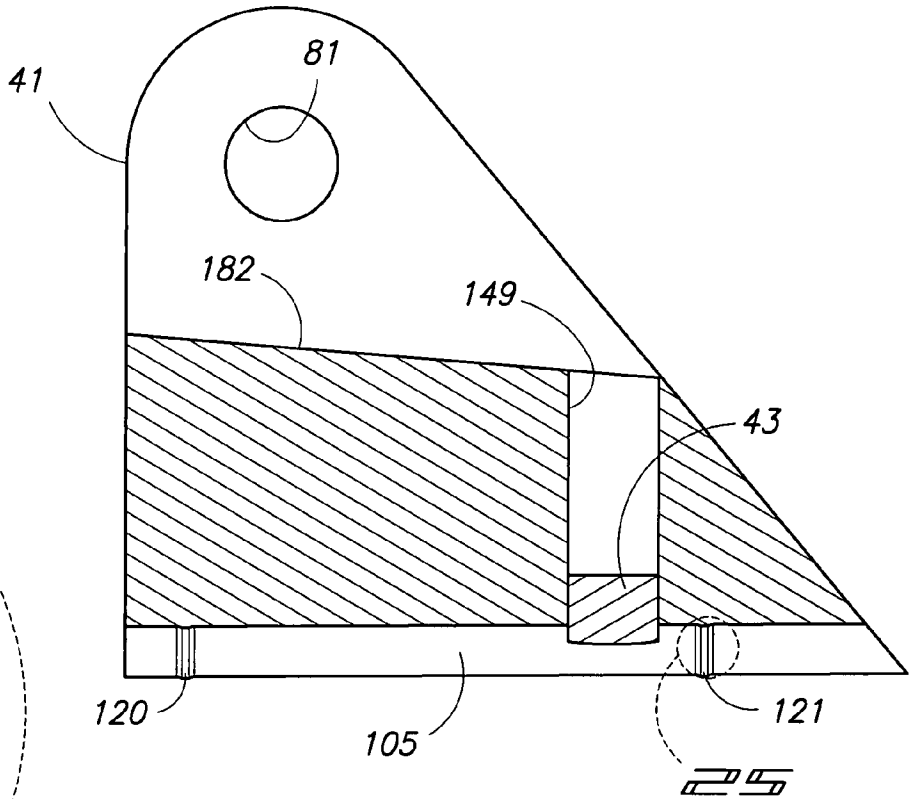
FIG. 24 is a vertical sectional view of the picket taken along line 24-24 of FIG. 23.
Figure 25:
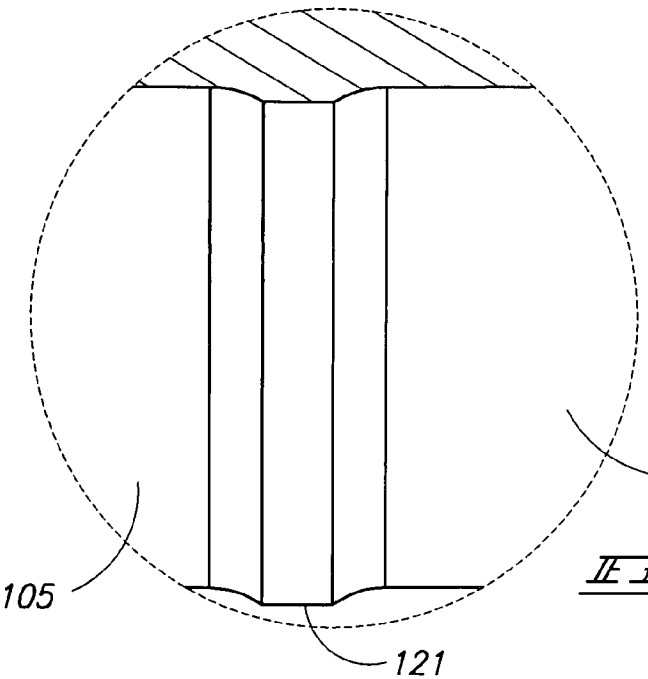
FIG. 25 is an enlarged view of one adhesive riser on the picket taken from the encircled region 25 of FIG. 24.

FIGS. 23-25 illustrate an exemplary construction for picket 41 which is proximate the breach end of a shotgun barrel. As shown in FIGS. 23 and 24, picket 41 includes a pair of aligned apertures 81 each provided within a respective side wing 181. Side wings 181 extend upwardly from a slope face 182 which provides for clearance of flange 57 (see FIG. 2) during articulation of a sighting rib respectively thereabout. A bore 149 is formed into slope face 182 to facilitate placement of a respective pin 43 (see FIG. 8A) when adhesively bonding picket 41 on top of a shotgun barrel. Adhesive risers 120 and 121 are provided along opposed edges of adhesive surface 105 in order to accommodate a desired, predefined thickness of adhesive between picket 41 and a shotgun barrel. FIG. 25 further illustrates the configuration of the arcuate adhesive riser 121 in relation to the respective adhesive surface 105.

Figure 26:
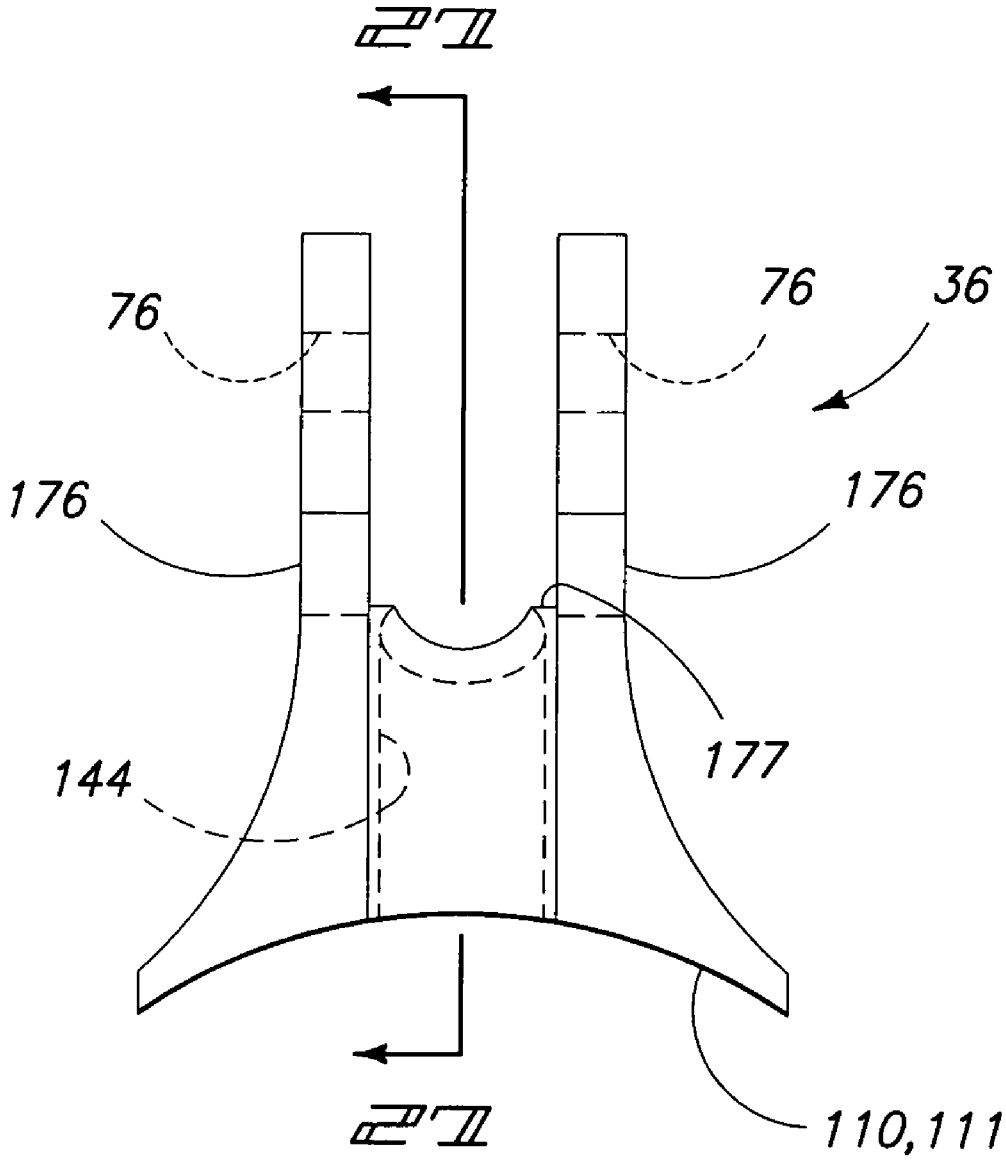
FIG. 26 is a left end view of a picket closest to the muzzle end of the barrel for the adjustable gun sight of FIGS. 1-22.
Figure 27:
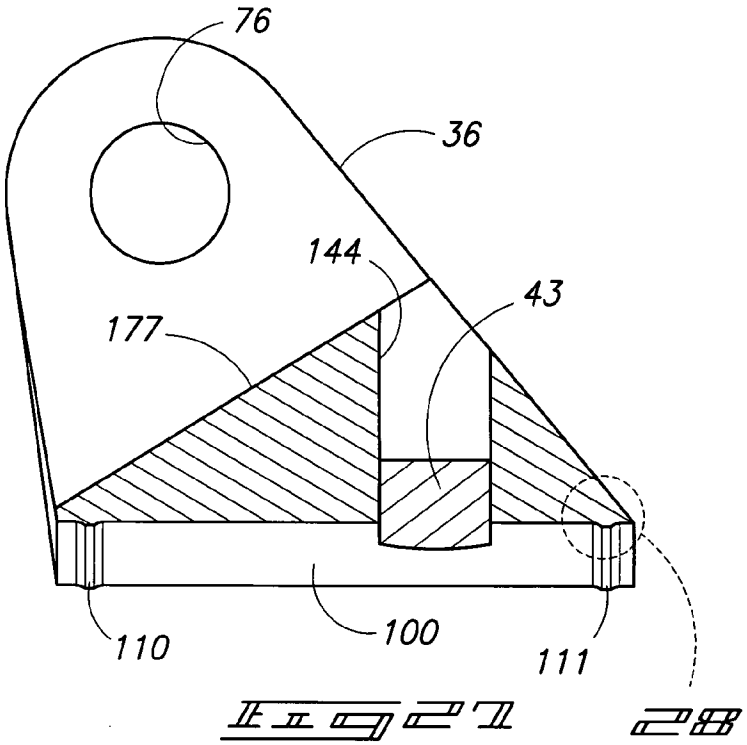
FIG. 27 is a vertical sectional view of the picket taken along line 27-27 of FIG. 26.
Figure 28:
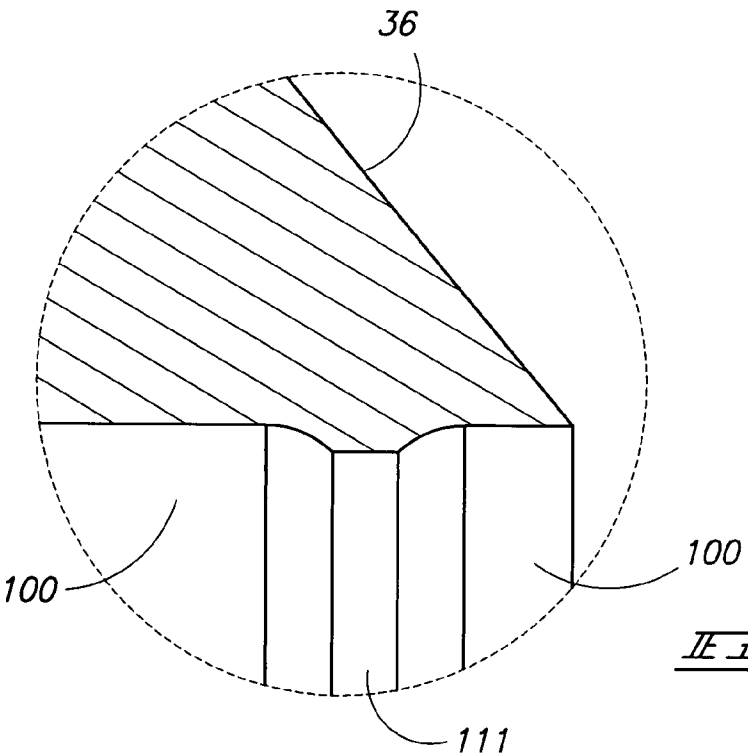
FIG. 28 is an enlarged view of one adhesive riser on the picket taken from the encircled region 28 of FIG. 27.
Figure 24:
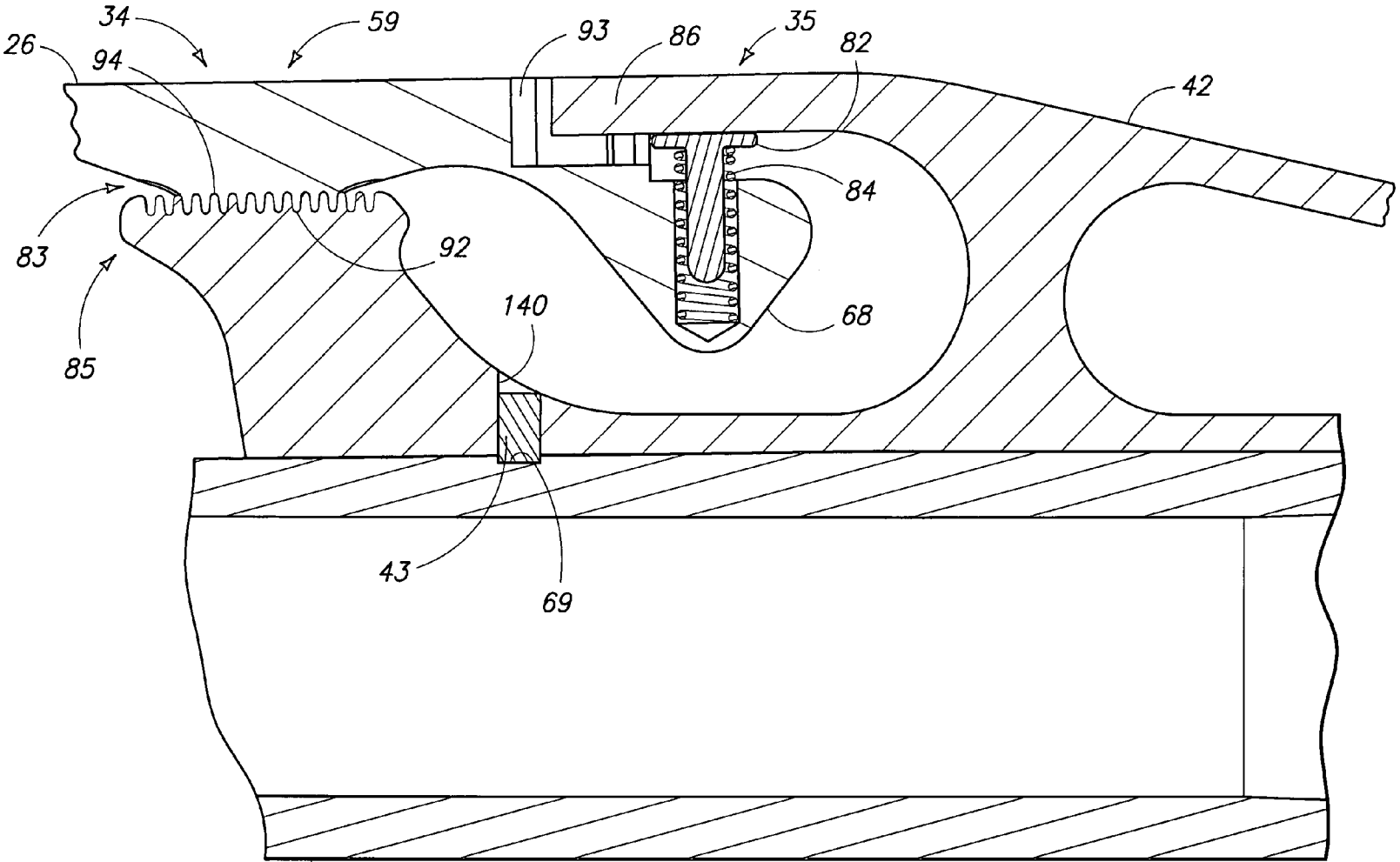

FIGS. 26-28 illustrate an exemplary construction for picket 36 which is proximate the muzzle end of a shotgun barrel. As shown in FIGS. 26 and 27, picket 36 includes a pair of aligned apertures 76 each provided within a respective side wing 176. Side wings 176 extend upwardly from a slope face 177 which provides for clearance of flange 52 (see FIG. 2) during articulation of a sighting rib respectively thereabout. A bore 144 is formed into slope face 177 to facilitate placement of a respective pin 43 (see FIG. 8A) when adhesively bonding picket 36 on top of a shotgun barrel. Adhesive risers 110 and 111 are provided along opposed edges of adhesive surface 100 in order to accommodate a desired, predefined thickness of adhesive between picket 36 and a shotgun barrel. FIG. 28 further illustrates the configuration of the arcuate adhesive riser 111 in relation to the respective adhesive surface 100.

Figure 30:
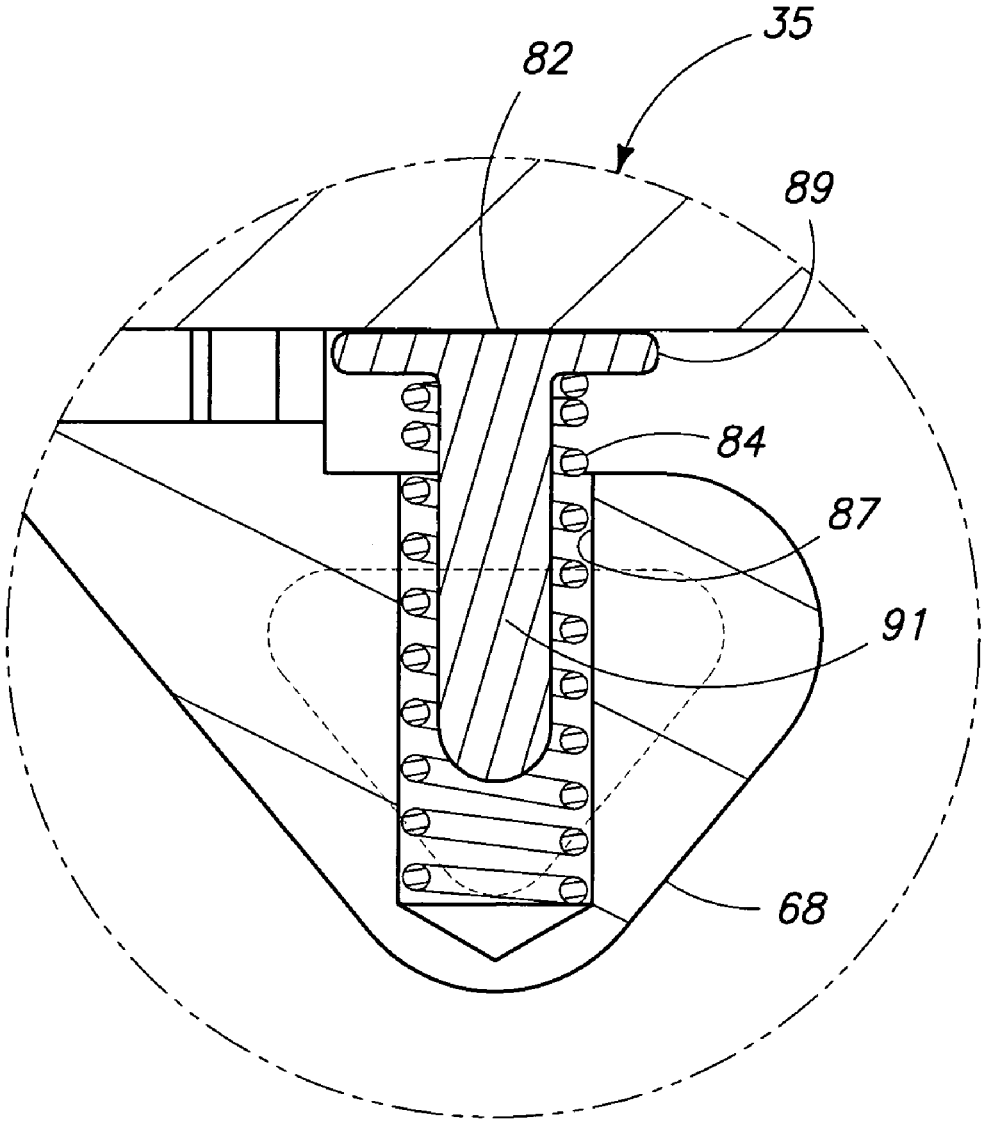
FIG. 30 is an even further enlarged vertical sectional view corresponding with the view of FIG. 29 and showing the spring lock of the adjustable gun sight.

FIGS. 29-30 further illustrate the construction of latch mechanism 34. Latch mechanism 34 includes connector 59 and spring lock 35. Connector 59 is selectively adjustable into five unique engagement positions between complementary surfaces 83 and 85. Such an arcuate projections 92 and 94 are engaged in five unique arrangements, each corresponding with a specific pitch for sighting rib 26 relative to barrel 24. The provision of pin 43 within bore 140 serves to further retain support bracket 42 when adhesively bonded atop barrel 24.

Furthermore, spring lock 35 includes finger 86 which is received in snug, sliding relation within complementary slot 93 on sighting rib 26. Slot 93 is slightly longer than finger 86 in order to accommodate relative movement of sighting rib 26 which occurs when repositioning arcuate projections 92 and 94 via selective positioning of connector 59.

Spring lock 35 of FIGS. 29 and 30 comprises a steel plunger 82 that is seated against a spring steel coil spring 84. Plunger 82 has a enlarged head 89 and an enlongated shaft 91 which is received within coil spring 84, as shown in FIG. 30. A cylindrical bore 87 is provided vertically downwardly within finger tab 68 in order to receive spring 84 and plunger 82. A top surface of plunger 82 acts on a bottom surface of finger 86 to downwardly bias finger tab 68 which ensures secured and locked engagement of arcuate projections 92 and 94 (see FIG. 29).

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A shotgun sight, comprising:

a barrel;

a sighting rib;

a rib support member provided on the barrel;

a pitch adjustment mechanism provided between the rib and the rib support member to adjust pitch of the rib relative to the barrel; and a hand-actuated latch mechanism having a pair of coacting base plates, a first base plate provided along a proximal end of the rib and a second base plate provided on the rib support member, each base plate having an array of complementary-shaped interlocking projections, the base plates configured to be urged apart from each other by hand to reposition the array of interlocking projections to selectively position the rib relative to the barrel at one of a plurality of locations, each location corresponding with a unique pitch for the rib relative to the barrel.

2. The shotgun sight of claim 1, wherein the first base plate is supported by a flexible bending beam provided by a flexible proximal end of the rib.

3. The shotgun sight of claim 2, further comprising a spring provided between the rib and the support member configured to urge together the complimentary-shaped interlocking projections on the first base plate and the second base plate.

4. The shotgun sight of claim 3, further comprising a finger tab provided on the first base plate to enable tactile manipulation to flex the first base plate relative to the second base plate, compressing the spring, and enabling repositioning of the first base plate and the second base plate corresponding with the rib being selectively positioned at a desired pitch relative to the barrel.

5. The shotgun sight of claim 1, wherein the pitch adjustment mechanism comprises a plurality of pickets spaced apart along the barrel and at least one bracket depending from the rib, a unique cam surface provided at a location corresponding with each picket by one of the respective picket and an associated portion of the at least one bracket to interact with a corresponding surface provided by another of the respective picket and the associated portion of the at least one bracket to adjust pitch of the rib relative to the barrel corresponding with selective positioning of the rib relative to the barrel.

6. The shotgun sight of claim 5, wherein the at least one bracket comprises a plurality of brackets, and the pitch adjustment mechanism further comprises a plurality of pins each affixed to a respective picket, and each unique cam surface comprises a cam slot provided in a respective bracket depending from the rib.

7. The shotgun sight of claim 1, wherein the rib support member comprises at least three discrete rib support members spaced apart along the barrel.

8. The shotgun sight of claim 7, wherein at least two of the rib support members each comprise a discrete support bracket configured to mate with a complementary bracket on the rib, and a cam surface provided at an interface between each rib support member and each respective, complementary bracket.

9. The shotgun sight of claim 8, wherein a third rib support member comprises a base support bracket, the second support plate provided by the base support bracket.

10. The shotgun sight of claim 1, wherein the array of interlocking projections of the hand-actuated latch mechanism provides a first adjustment position and an adjacent, second adjustment position, such that a line of sight atop the sighting rib when in the first position and the second position intersects at a location aft of a trigger end of the barrel.

11. The shotgun sight of claim 1, wherein the line of sight in the first position and the second position intersects in proximity with a shooter's sight eye while in a shooting configuration with the shooter's chin in contact with a cheek piece of the shotgun.

12. An adjustable gun sight, comprising:

a support base having a mounting interface configured to mount onto a gun barrel;

a sighting rib;

a pitch adjustment structure provided between the support base and the sighting rib to retain the rib relative to the mounting interface at selective pitch orientations; and a latch connection having a first finger supported by the sighting rib with a first connector portion and a second finger supported by the support base with a second connector portion, each of the connector portions having an array of complementary-shaped interlocking projections, the first finger and the second finger configured to be urged apart from each other to disengage the first connector portion and the second connector portion to articulate the pitch adjustment structure to realize a desired pitch of the rib relative to the mounting interface.

13. The gun sight of claim 12, further comprising a spring configured to urge together the first connector portion and the second connector portion.

14. The gun sight of claim 12, wherein the first finger comprises a resilient finger provided by a proximal end of the rib having a finger-gripping appendage usable to flex the resilient finger to disengage the first connector portion from the second connector portion.

15. The gun sight of claim 12, wherein the first connector portion and the second connector portion comprise complementary surfaces each having interlocking projections that are selectively repositionable one to the other corresponding with specific pitch positions of the rib relative to the mounting interface.

16. The gun sight of claim 15, wherein each complementary surface comprises an array of selectively interlocking arcuate projections.

17. The gun sight of claim 12, wherein the mounting interface of the support base comprises an adhesive riser sized to provide a predetermined thickness of adhesive between the mounting interface and a bonding surface of a gun barrel.

18. The gun sight of claim 12, wherein the support base comprises an array of substantially equally spaced-apart pickets each having a surface configured to cooperate with a respective portion of the sighting rib via a cam surface to modify pitch of the sighting rib relative to the pickets as the sighting rib is moved kinematically relative to the pickets.

19. The gun sight of claim 18, wherein each cam surface is provided by a cam slot provided in a bracket provided by the sighting rib.

* * * * *

UNITED STATES PATENT AND TRADEMARK OFFICE

CERTIFICATE OF CORRECTION

PATENT NO. : 7,540,108 B2
APPLICATION NO. : 11/651301
DATED : June 2, 2009
INVENTOR(S) : Irwin et al.

It is certified that error appears in the above-identified patent and that said Letters Patent is hereby corrected as shown below:

Column 5, Line 16 - Replace "3641" with --36-41--.

Column 6, Line 14 - Replace "3641" with --36-41--.

Column 8, Line 10 - Replace "elongate" with --elongated--.

Column 8, Line 42 - Replace "3641" with --36-41--.

Column 10, Lines 18-19 - Replace "Arcuate projections 64" with --Arcuate projections 92--.

Signed and Sealed this

Twenty-fourth Day of August, 2010

David J. Kappos

David J. Kappos
*Director of the United States Patent and Trademark Office*